US011633647B2

(12) United States Patent
Fedriga

(10) Patent No.: US 11,633,647 B2
(45) Date of Patent: Apr. 25, 2023

(54) SELECTIVELY ADJUSTABLE RESISTANCE ASSEMBLIES AND METHODS OF USE FOR EXERCISE MACHINES

(71) Applicant: Technogym S.p.A., Cesena (IT)

(72) Inventor: Mario Fedriga, Castrocaro Terme e Terra del Sole (IT)

(73) Assignee: Technogym S.p.A., Cesena (IT)

( * ) Notice: Subject to any disclaimer, the term of this patent is extended or adjusted under 35 U.S.C. 154(b) by 180 days.

(21) Appl. No.: 17/220,923

(22) Filed: Apr. 1, 2021

(65) Prior Publication Data

US 2021/0236882 A1 Aug. 5, 2021

Related U.S. Application Data

(63) Continuation-in-part of application No. 17/145,847, filed on Jan. 11, 2021, now abandoned, which is a (Continued)

(30) Foreign Application Priority Data

Jun. 12, 2020 (IT) ..... 102020000014092

(51) Int. Cl.
*A63B 24/00* (2006.01)
*A63B 21/005* (2006.01)
(Continued)

(52) U.S. Cl.
CPC ..... *A63B 24/0087* (2013.01); *A63B 21/0056* (2013.01); *A63B 21/225* (2013.01);
(Continued)

(58) Field of Classification Search
CPC ..... A63B 21/00058; A63B 21/00069; A63B 21/00076; A63B 21/00192; A63B 21/005;
(Continued)

(56) References Cited

U.S. PATENT DOCUMENTS 2,936,650 A 5/1960 Gleasman et al.
3,021,728 A 2/1962 Keizo
(Continued)

FOREIGN PATENT DOCUMENTS

AT 505617 A4 3/2009
CN 101842138 A 9/2010
(Continued)

OTHER PUBLICATIONS

"Search Report" and "Written Opinion," Italian Patent Application No. IT201600083062, dated Apr. 21, 2017, 5 pages (7 pages including English Translation).
(Continued)

*Primary Examiner* — Gary D Urbiel Goldner
(74) *Attorney, Agent, or Firm* — Carr & Ferrell LLP

(57) ABSTRACT

The present invention relates to selectively adjustable speed and incline levels for treadmills. An example treadmill includes a platform around which a belt rotates, a drive motor for controlling a speed of rotation of the belt, a linear motor for controlling an incline of the platform, a human machine interface configured to receive from a user a first selection regarding at least one of the speed of rotation of the belt and the incline of the platform, at least one manual lever configured to receive from the user a second selection to respectively refine the first selection, and at least one controller that selectively changes the speed of rotation of the belt or the incline of the platform based on the first selection received by the human machine interface, and selectively and respectively refines the first selection based on the second selection received by the at least one manual lever.

20 Claims, 15 Drawing Sheets

Related U.S. Application Data continuation of application No. 16/283,565, filed on Feb. 22, 2019, now Pat. No. 10,888,736.

(51) Int. Cl.
*A63B 21/22* (2006.01)
*A63B 22/06* (2006.01)
*A63B 71/06* (2006.01)

(52) U.S. Cl.
CPC ..... *A63B 22/0605* (2013.01); *A63B 71/0622* (2013.01); *A63B 2071/0625* (2013.01)

(58) Field of Classification Search
CPC ..... A63B 21/0051; A63B 21/0052; A63B 21/0056; A63B 21/0058; A63B 21/15; A63B 21/159; A63B 22/0015; A63B 22/0017; A63B 22/0023; A63B 22/0046; A63B 22/02; A63B 22/0235; A63B 22/0242; A63B 22/025; A63B 22/0257; A63B 22/0264; A63B 2022/002; A63B 24/0062; A63B 24/0075; A63B 24/0087; A63B 2024/0065; A63B 2024/0068; A63B 2024/009; A63B 2024/0093; A63B 71/0054; A63B 71/0619; A63B 71/0622; A63B 2071/0072; A63B 2071/0625; A63B 2071/0675; A63B 2071/0683; A63B 2225/20; A63B 2225/50
See application file for complete search history.

(56) References Cited

U.S. PATENT DOCUMENTS

| | | | | |
|---|---|---|---|---|
| 5,215,468 | A | 6/1993 | Lauffer et al. | |
| 5,616,104 | A | 1/1997 | Mulenburg et al. | |
| 6,050,924 | A | 4/2000 | Shea | |
| 6,450,922 | B1 | 9/2002 | Henderson et al. | |
| 6,902,513 | B1 | 6/2005 | McClure | |
| 7,651,423 | B2 | 1/2010 | Ichida et al. | |
| 9,302,148 | B1 | 4/2016 | Vujicic et al. | |
| 10,272,280 | B2 | 4/2019 | Leonardi et al. | |
| 10,576,348 | B1 | 3/2020 | Hawkins, III et al. | |
| 10,773,121 | B2 * | 9/2020 | Del Monaco | A63B 22/02 |
| 10,799,755 | B2 | 10/2020 | Cristofori et al. | |
| 10,888,736 | B2 | 1/2021 | Fedriga | |
| 11,040,247 | B2 | 6/2021 | Casalini | |
| 11,079,918 | B2 | 8/2021 | Rotta | |
| 2003/0040348 | A1 | 2/2003 | Martens | |
| 2003/0171190 | A1 | 9/2003 | Rice | |
| 2006/0003872 | A1 | 1/2006 | Chiles et al. | |
| 2006/0084551 | A1 | 4/2006 | Volpe, Jr. | |
| 2006/0234840 | A1 | 10/2006 | Watson et al. | |
| 2007/0281828 | A1 | 12/2007 | Rice | |
| 2008/0103030 | A1 | 5/2008 | Watson et al. | |
| 2008/0207402 | A1 | 8/2008 | Fisher et al. | |
| 2008/0242511 | A1 * | 10/2008 | Munoz | A63B 22/02 482/5 |
| 2009/0011907 | A1 | 1/2009 | Radow et al. | |
| 2009/0118099 | A1 | 5/2009 | Fisher et al. | |
| 2009/0118100 | A1 | 5/2009 | Oliver et al. | |
| 2009/0217780 | A1 | 9/2009 | Evett | |
| 2009/0227429 | A1 | 9/2009 | Baudhuin | |
| 2010/0113223 | A1 | 5/2010 | Chiles et al. | |
| 2010/0292600 | A1 | 11/2010 | DiBenedetto | |
| 2011/0118086 | A1 | 5/2011 | Radow et al. | |
| 2011/0196519 | A1 | 8/2011 | Khoury et al. | |
| 2011/0317069 | A1 | 11/2011 | McRae | |
| 2012/0238406 | A1 | 9/2012 | Beard et al. | |
| 2013/0059698 | A1 | 3/2013 | Barton | |
| 2014/0171266 | A1 | 6/2014 | Hawkins, III et al. | |
| 2014/0224055 | A1 | 8/2014 | Cracco et al. | |
| 2014/0361511 | A1 | 12/2014 | Thompson | |
| 2014/0378280 | A1 | 12/2014 | Kristiansen et al. | |
| 2015/0080190 | A1 | 3/2015 | Kaan et al. | |
| 2015/0228262 | A1 | 8/2015 | Silfvast et al. | |
| 2015/0290490 | A1 | 10/2015 | Badarneh | |
| 2015/0344103 | A1 | 12/2015 | Kuroda | |
| 2015/0344104 | A1 | 12/2015 | Kuroda | |
| 2016/0236751 | A1 | 8/2016 | Rosen | |
| 2016/0266867 | A1 | 9/2016 | Olesh et al. | |
| 2016/0311483 | A1 | 10/2016 | Laronde | |
| 2016/0346596 | A1 * | 12/2016 | Manzke | A63B 21/00069 |
| 2016/0346598 | A1 * | 12/2016 | Manzke | A63B 22/0023 |
| 2017/0136289 | A1 * | 5/2017 | Frank | A63B 22/025 |
| 2017/0225023 | A1 * | 8/2017 | Crist | A63B 22/0023 |
| 2017/0334518 | A1 | 11/2017 | Bortoli et al. | |
| 2018/0001142 | A1 | 1/2018 | Viarani et al. | |
| 2018/0036586 | A1 | 2/2018 | Cristofori et al. | |
| 2018/0043206 | A1 | 2/2018 | Crist et al. | |
| 2018/0056132 | A1 | 3/2018 | Foley et al. | |
| 2018/0126248 | A1 | 5/2018 | Dion et al. | |
| 2018/0126249 | A1 | 5/2018 | Consiglio et al. | |
| 2018/0140903 | A1 | 5/2018 | Poure et al. | |
| 2019/0111318 | A1 * | 4/2019 | Evancha | A63B 24/0062 |
| 2019/0143194 | A1 | 5/2019 | Evancha et al. | |
| 2019/0321680 | A1 * | 10/2019 | Manzke | A63B 71/0054 |
| 2019/0336827 | A1 * | 11/2019 | Intonato | A63B 71/0622 |
| 2019/0366149 | A1 * | 12/2019 | Crist | A63B 21/0552 |
| 2020/0009444 | A1 | 1/2020 | Putnam | |
| 2020/0147449 | A1 | 5/2020 | Liu et al. | |
| 2020/0269090 | A1 | 8/2020 | Fedriga | |
| 2020/0272311 | A1 | 8/2020 | Rotta | |
| 2020/0276475 | A1 | 9/2020 | Casalini | |
| 2020/0376329 | A1 * | 12/2020 | Liao | A63B 21/0058 |
| 2021/0128984 | A1 * | 5/2021 | Fedriga | A63B 71/0622 |
| 2021/0170222 | A1 * | 6/2021 | Consiglio | A63B 22/02 482/5 |

FOREIGN PATENT DOCUMENTS

| | | | |
|---|---|---|---|
| CN | 102893063 | A | 1/2013 |
| CN | 107684696 | A | 2/2018 |
| CN | 107684696 | B | 6/2020 |
| EP | 2564904 | A1 | 3/2013 |
| EP | 2571280 | A2 | 3/2013 |
| EP | 2703051 | A2 | 3/2014 |
| EP | 2949367 | A1 | 2/2015 |
| EP | 3278842 | A2 | 2/2018 |
| EP | 3278842 | A3 | 6/2018 |
| EP | 3278842 | B1 | 7/2020 |
| EP | 3698855 | A1 | 8/2020 |
| EP | 3698856 | A1 | 8/2020 |
| EP | 3703068 | A1 | 9/2020 |
| IT | 201600083062 | A1 | 8/2016 |
| TW | M510779 | U | 10/2015 |
| TW | 201808403 | A | 3/2018 |
| TW | I721203 | B | 3/2021 |
| WO | WO1987001953 | | 4/1987 |
| WO | WO1992020408 | A1 | 11/1992 |
| WO | WO2008002644 | A2 | 1/2008 |
| WO | WO 2009003170 | A1 | 12/2008 |
| WO | WO2018035117 | A1 | 2/2018 |

OTHER PUBLICATIONS

"Office Action," Chinese Patent Application No. 201710662848.4, dated Jan. 21, 2019, 8 pages (15 pages including English Translation).

"Office Action," Chinese Patent Application No. 201710662848.4, dated Sep. 23, 2019, 4 pages (11 pages including English Translation).

"Partial European Search Report", Euorpean Patent Application No. EP17184196.8 dated Dec. 22, 2017, 15 pages.

"Extended European Search Report", Euorpean Patent Application No. EP17184196.8 dated May 9, 2018, 13 pages.

"Extended European Search Report", European Patent Application No. EP20159062.7, dated Jun. 16, 2020, 6 pages.

"Extended European Search Report", European Patent Application No. EP20158332.5, dated Jun. 26, 2020, 8 pages.

(56) References Cited

OTHER PUBLICATIONS

"Extended European Search Report", European Patent Application No. EP20159696.2, dated Jul. 13, 2020, 15 pages.
Goode, Lauren, "My Two-Month Ride with Peloton, the Cultish, Internet-Connected Fitness Bike," The Verge [online], Apr. 25, 2017, [retrieved on Jul. 1, 2020], Retrieved from the Internet: <URL:https://www.theverge.com/2017/4/25/15408338/bike-peloton-review-indoor-cycle-live-streaming-cycling>, 10 pages.
"Notice of Allowance", European Patent Application No. 17184196.8, dated Jul. 2, 2020, 2 pages.

* cited by examiner

| | Beginner | Intermediate | Advanced |
|---|---|---|---|
| TOP | 8 | 10 | 12 |
| CLIMB | 6 | 8 | 10 |
| HILL | 5 | 6 | 8 |
| FLAT | 3 | 5 | 6 |

FIG. 8A

| | Beginner | Intermediate | Advanced |
|---|---|---|---|
| TOP | 7 | 9 | 11 |
| CLIMB | 5 | 7 | 9 |
| HILL | 2 | 4 | 6 |
| FLAT | 0 | 0 | 0 |

FIG. 8B

| | Beginner | Intermediate | Advanced |
|---|---|---|---|
| SPRINT | 11.0 | 13.0 | 16.0 |
| RUN | 8.0 | 9.0 | 10.0 |
| JOG | 6.5 | 7.5 | 8.5 |
| WALK | 4.5 | 5.5 | 6.5 |

FIG. 8C

SELECTIVELY ADJUSTABLE RESISTANCE ASSEMBLIES AND METHODS OF USE FOR EXERCISE MACHINES

CROSS REFERENCE TO RELATED APPLICATIONS

This application is a Continuation-in-part of, and claims the priority benefit of, U.S. patent application Ser. No. 17/145,847 filed on Jan. 11, 2021, which in turn is a Continuation of, and claims priority to, U.S. patent application Ser. No. 16/283,565, filed on Feb. 22, 2019 and titled "Selectively Adjustable Resistance Assemblies and Methods of Use for Bicycles." This application further claims priority to Italian patent application number 102020000014092 filed on Jun. 12, 2020. Each of the above-referenced applications are hereby incorporated by reference in their entirety.

FIELD OF THE INVENTION

The present disclosure generally pertains to exercise apparatuses, and more particularly, but not by limitation, to selectively adjustable resistance assemblies and methods of use for exercise apparatuses, such as bicycles and treadmills. Some embodiments allow users to select resistance levels from a plurality of resistance settings, and refine their selected resistance level through manual actuation.

BACKGROUND

Conventional exercise machines, such as stationary bicycles and treadmills, do not permit a user to adjust the resistance of the machine in a comfortable and suitable way. Adjusting assemblies of some devices provide slow and inaccurate resistance settings. Consequently, there remains an unmet need in the art to provide a workout device, such as a stationary bicycle or treadmill, that enables quick and accurate adjustments of the resistance to pedaling or a speed and/or incline of a treadmill belt, to improve training in terms of experience and effectiveness.

SUMMARY

A system of one or more computers can be configured to perform operations or actions by virtue of having software, firmware, hardware, or a combination of them installed on the system that in operation causes or cause the system to perform the actions. One or more computer programs can be configured to perform operations or actions by virtue of including instructions that, when executed by data processing apparatus, cause the apparatus to perform the actions.

One general aspect includes a method comprising receiving a first selection from a user through a human machine interface of an exercise device, the first selection controlling a difficulty level of a workout on the exercise device; controlling the settings on the exercise device to selectively change a difficulty level based on the first selection; receiving a second selection from a manual selector; and controlling the exercise device to selectively refine the difficulty level based on the second resistance selection.

Other aspects and embodiments are discussed in further detail herein.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

FIGS. 8A-8C depict exemplary predefined resistance levels that may be utilized by the presently disclosed exercise machines.

DETAILED DESCRIPTION

Figure 1:
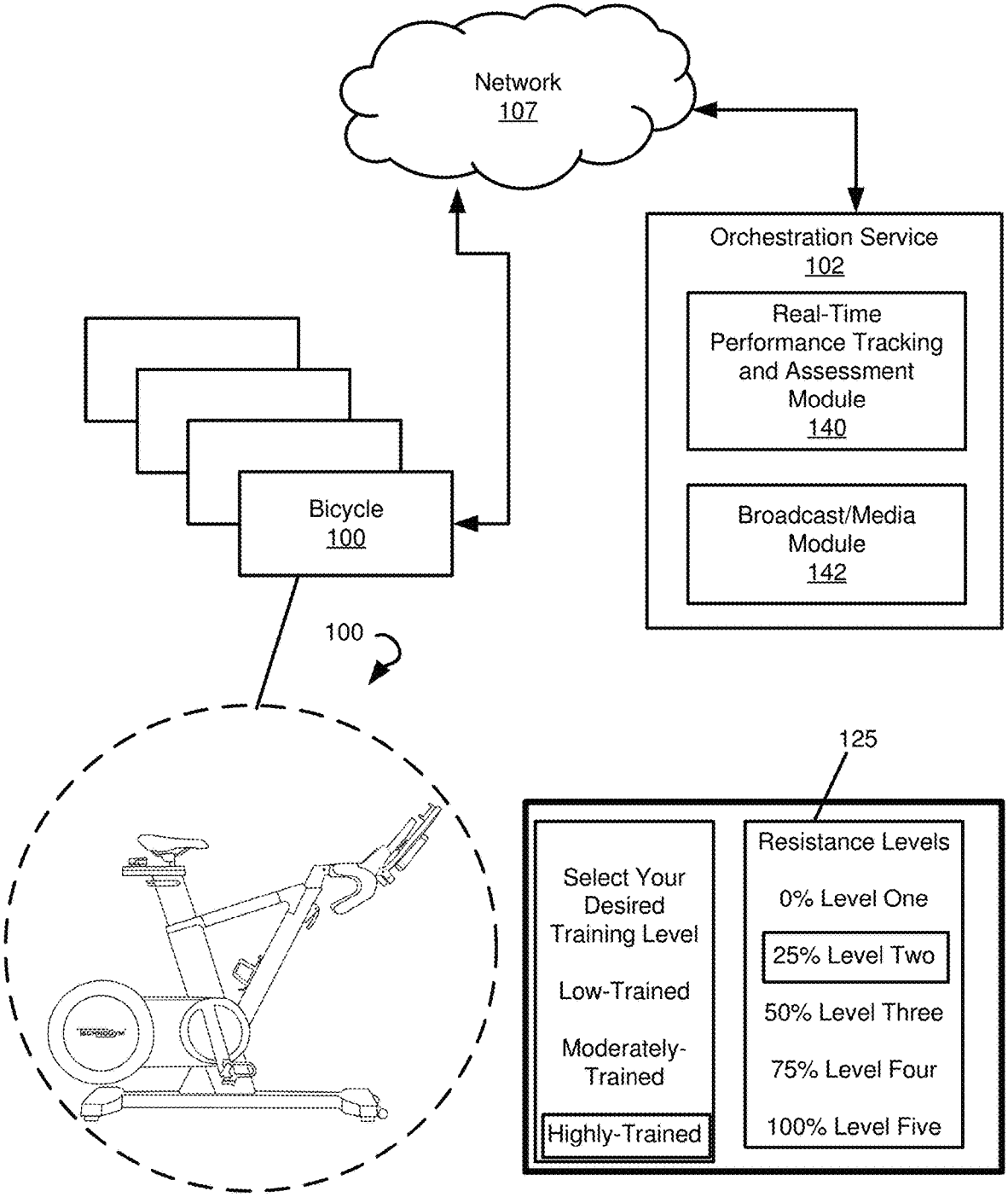
FIG. 1 is a schematic diagram of an example environment where aspects and embodiments of the present disclosure can be performed.

Generally speaking, the present disclosure is directed to selectively adjustable resistance assemblies and methods of use for exercise machines. In one embodiment, these assemblies and methods can be implemented within stationary bicycles. An adjustable resistance assembly of the present disclosure allows for selective adjustment of a resistance force applied to a flywheel of a bicycle to at least partially counteract a pedaling force generated by a user. This allows for variation in intensity of force required from the user to turn the flywheel using the pedals of the bicycle.

In another embodiment, these assemblies and methods can be implemented within a treadmill. Macro adjustments and micro adjustments in belt speed and/or belt incline can be made to a training level selected by a user, to increase or decrease the intensity of the workout.

In various embodiments, the user is presented with a plurality of resistance settings that are each associated with a unique selection for the resistance force. The user can select one of these resistance settings as a first resistance selection. In general, the first resistance selection is referred to as a macro-level resistance selection. In one embodiment, the resistance settings are stratified such that each higher level selection (for example from selections 1-5) equates to a greater amount of resistance force that is applied to the flywheel. Thus, the user must exert more effort to pedal the bicycle and turn the flywheel.

Additionally, the user can employ a manual resistance selector, such as a lever to selectively refine the resistance force based on the first resistance selection. This is referred to herein as a second resistance selection. The second resistance selection is a micro-level resistance selection that fine-tunes or adjusts the resistance force that was established based on the first resistance selection. This fine tuning can include either increasing or decreasing the resistance force that was established based on the first resistance selection.

According to some embodiments, the system and methods disclosed herein advantageously allow a user to rapidly change between resistance selections on a macro or large scale, for example by allowing transitions from the plurality of the macro-levels of resistance. Also, another advantage allows for refinement of the macro-level resistance through micro-level resistance setting selections using, for example, manual or virtual actuators (collectively user-actuated resistance selector(s)). Advantageously, a user can select the first macro-level resistance selection to locate a desired and proper resistance, to maximize the effects of the workout. The user can then fine-tune the first macro-level resistance selection using user-actuated resistance selector(s) to incrementally change the resistance level relative to the first macro-level resistance selection.

In various embodiments, the resistance force is controlled using a resistance assembly that is coupled with the flywheel of the bicycle. The resistance assembly can be operated through a controller that receives input from a user through a human machine interface associated with the bicycle.

In some embodiments, the resistance settings can be based on a current training level for a user. In other embodiments, the current training level can be inferred or calculated using historical performance data for the user collected over time. These and other advantages of the present disclosure are provided in detail herein with reference to the collective drawings.

FIG. 1 is a schematic diagram of an example environment where aspects and embodiments of the present disclosure can be practiced. The environment comprises one or more bicycles, such as bicycle 100, an orchestration service 102, and a network 107. In general, the bicycle 100 and orchestration service 102 can communicatively couple together through the network 107. The network 107 may include any one or a combination of multiple different types of networks, such as cable networks, the Internet, cellular networks, wireless networks, and other private and/or public networks. In some instances, the network 107 may include Bluetooth, Wi-Fi, or Wi-Fi direct. The bicycle 100 may be a stand-alone device in a user's home or alternatively be one of a plurality of bicycles in a workout facility or other similar location. Additional features included in FIG. 1 will be discussed and referenced infra.

Figure 2:
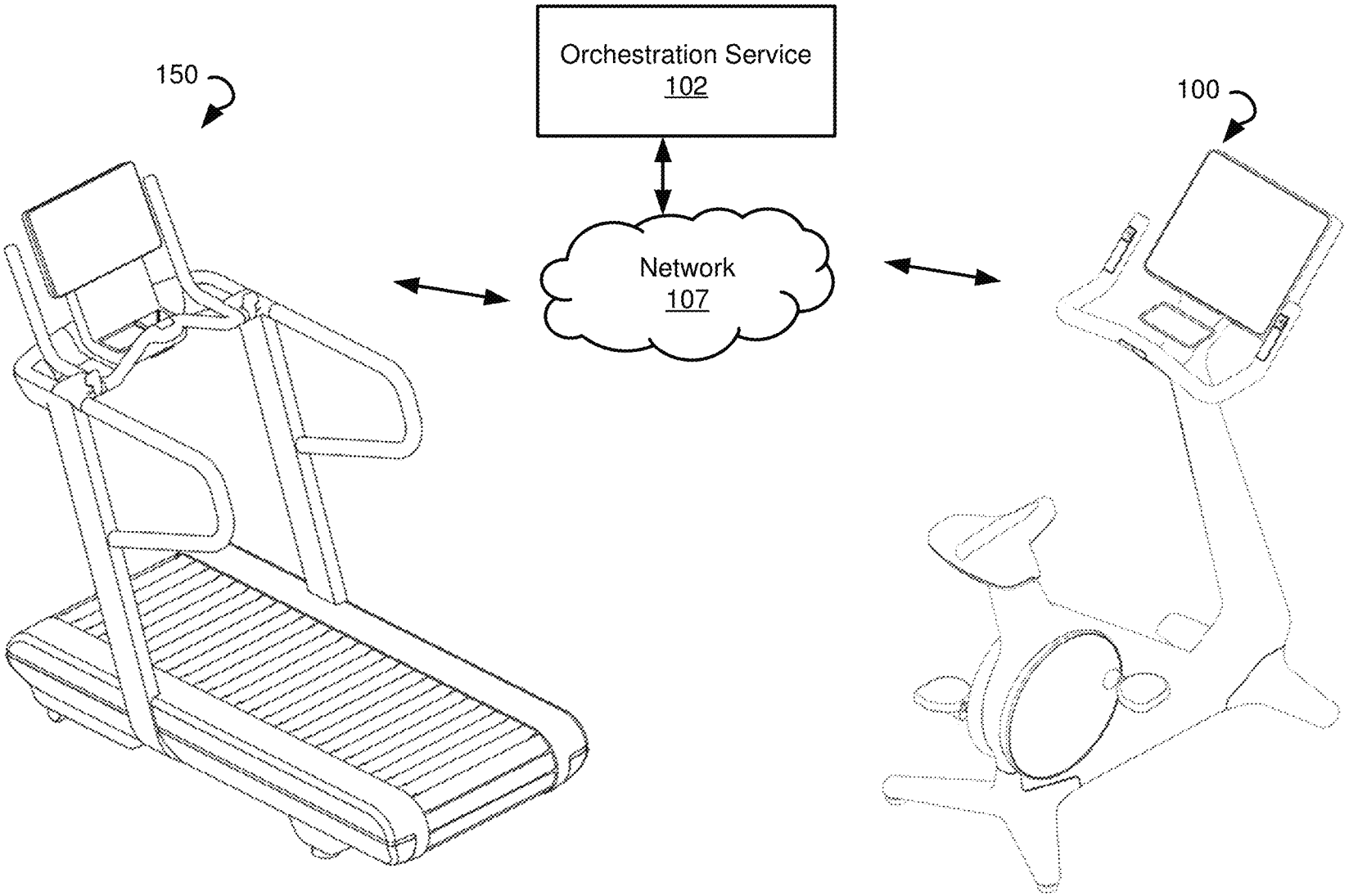
FIG. 2 is a schematic diagram of another example environment where aspects and embodiments of the present disclosure can be performed.

FIG. 2 is another schematic diagram of an example environment where aspects and embodiments of the present disclosure can be practiced. The environment may comprise one or more bicycles, such as bicycle 100, and/or one or more treadmills, such as treadmill 150. The one or more bicycles and/or one or more treadmills may communicate with orchestration service 102 via network 107, as discussed herein with reference to FIG. 1. While both a bicycle 100 and a treadmill 150 are depicted in exemplary FIG. 2, embodiments of the present disclosure may have only one or more bicycles, only one or more treadmills, or a combination of both exercise machines.

Figure 3:
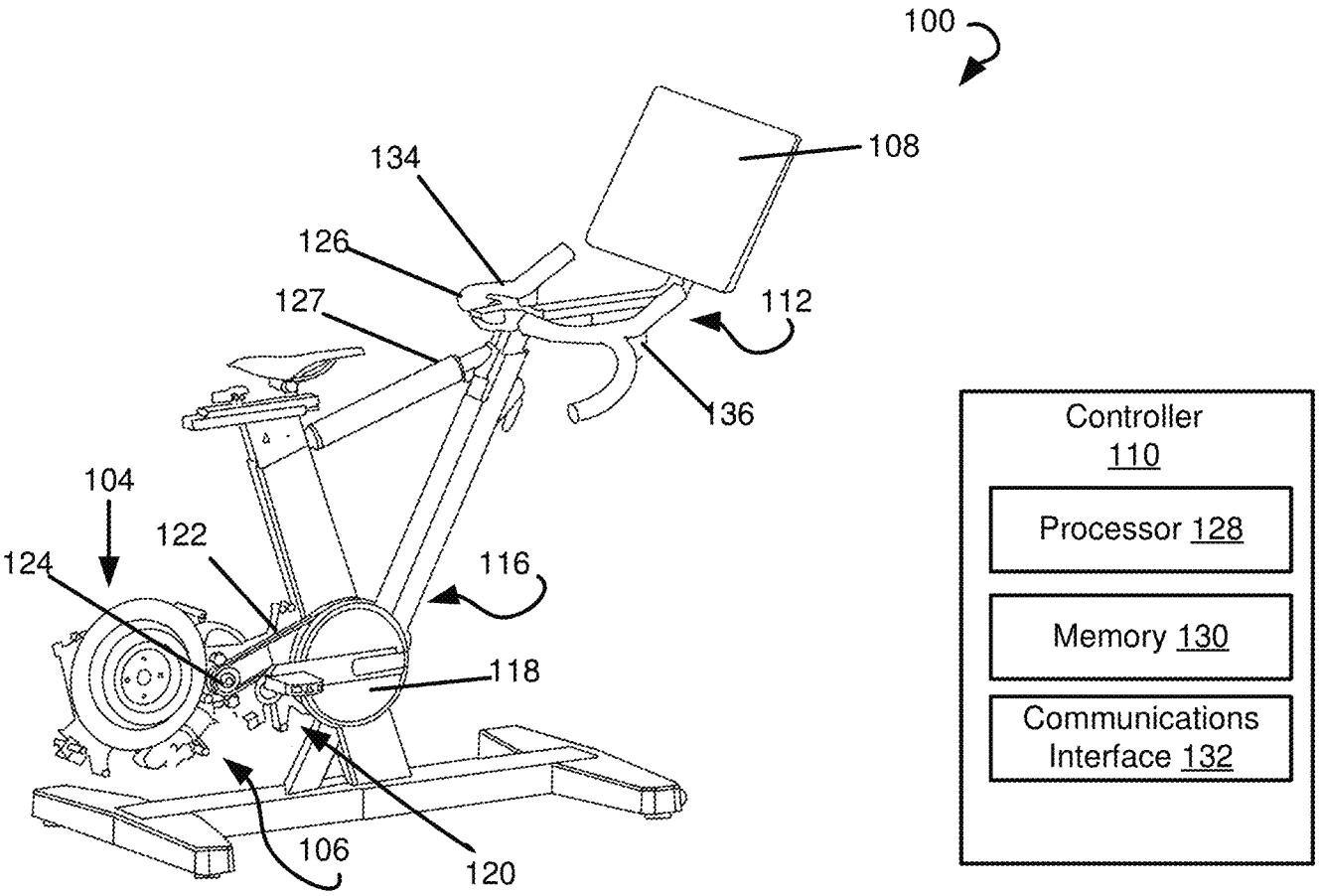
FIG. 3 is a schematic diagram of a device that is configured for use in accordance with embodiments of the present disclosure.

FIG. 3 illustrates additional details regarding the bicycle 100. In some embodiments, the bicycle 100 includes a stationary bicycle. Generally, the bicycle 100 comprises a flywheel 104, a resistance assembly 106, a human machine interface 108, a controller 110, and a secondary resistance selector which may also be referred to as a user-actuated resistance selector 112.

In more detail, the flywheel 104 is mounted to a drive assembly 116 of the bicycle 100. The drive assembly 116 can comprise a pedal interface 118 that is rotatably mounted to a frame of the bicycle 100. The pedal interface 118 allows a pair of pedals, such as pedal 120 to spin and rotate a cylindrical body of the pedal interface 118. As the pedal interface 118 is rotated, a chain 122 transfers motion to a gear 124 that is coupled to the flywheel 104. Thus, pedaling causes a corresponding rotation of the flywheel 104 through the chain and gear arrangement. Additional details regarding example embodiments of the drive assembly 116 can be found in co-owned U.S. application Ser. No. 15/668,519, filed on Aug. 3, 2017, titled "GYMNASTIC APPARATUS FOR CYCLING SIMULATION AND OPERATING METHODS THEREOF", now granted as U.S. Pat. No. 10,799,755 issued on Oct. 13, 2020, which is hereby incorporated by reference herein in its entirety, including all references and appendices cited therein, for all purposes. For example, FIGS. 2-11C of the '519 application and any corresponding descriptions provide additional details on the drive assembly 116, but are not intended to be limiting but are provided for purposes of illustration. Also, the '519 application provides example illustrations and descriptions of example embodiments the resistance assembly 106 that can be incorporated into the apparatuses and methods of the present disclosure.

In various embodiments, the resistance assembly 106 is configured to apply a resistance force that counteracts or resists the pedaling force generated by a user through the drive assembly 116. That is, the resistance assembly 106 applies a resistance force that makes pedaling the bicycle 100 more difficult for the user relative to when no resistance force is applied. In accordance with the present disclosure, the resistance force is selectable, as will be discussed in greater detail herein.

Figure 4A:
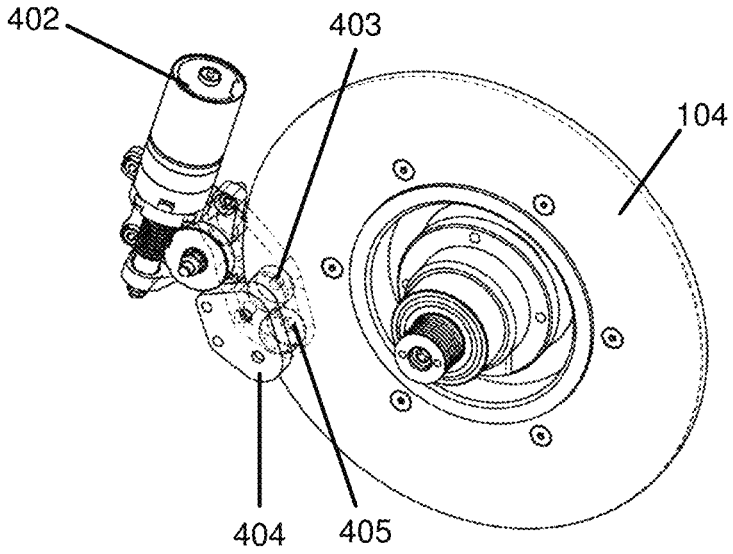
FIG. 4A is a perspective view of an example resistance assembly that can be utilized in some embodiments of the present disclosure.
Figure 4B:
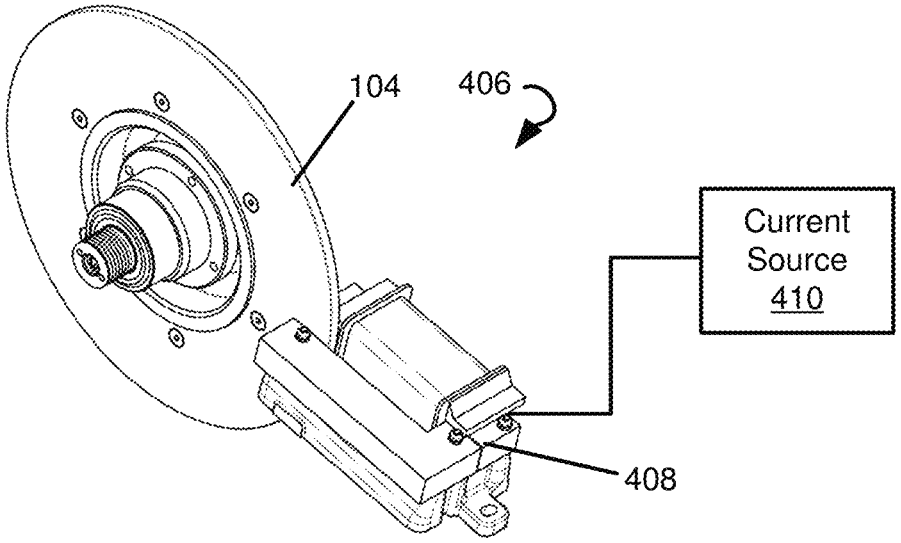
FIG. 4B is a perspective view of another example resistance assembly that can be utilized in some embodiments of the present disclosure.

FIGS. 4A and 4B illustrate example embodiments of the resistance assembly 106. As best illustrated in FIG. 4A, in some embodiments the resistance assembly 106 can include an electric motor 402 and a magnetic holder bracket 404. The resistance assembly 106 is illustrated in combination with the flywheel 104 of FIG. 1. In another embodiment, as illustrated in FIG. 4B, the resistance assembly 106 can include an electromagnetic brake 406 that comprises an electromagnet 408 coupled to a current source 410. To be sure, these are merely example resistance assemblies. Again, the resistance assembly 106 is illustrated in combination with the flywheel 104 of FIG. 1.

Referring to FIG. 3, the human machine interface (HMI) 108 can include, for example, a touchscreen display that is mounted anywhere on the bicycle 100. In one or more embodiments, the HMI 108 is mounted between handlebars 126 of the bicycle 100. In general, the HMI 108 is configured to display a plurality of resistance settings for a user. In one embodiment, the resistance settings include five distinct resistance settings that are each associated with a unique selection for the resistance force that can be applied to the flywheel 104 by the resistance assembly 106. However, as would be understood by persons of ordinary skill in the art, any number of distinct resistance settings can be provided, with each resistance setting associated with a unique selection for the resistance force applied to the flywheel 104 by the resistance assembly 106.

In one example, a first resistance setting is associated with a zero resistance level, a second resistance setting is associated with a 25 percent resistance level, a third resistance setting is associated with a 50 percent resistance level, a fourth resistance setting is associated with a 75 percent resistance level, and a fifth resistance setting is associated with a 100 percent resistance level. It will be understood that the percentages referenced in this example include are based on a maximum resistance force that can be applied by the resistance assembly 106 to the flywheel 104. These resistance settings can be selectively modified as will be discussed in greater detail herein. In FIG. 1, an example display 125 is illustrated, where the user has selected a Highly-trained Training Level and a corresponding list of predetermined resistance levels associated with the Training Level are displayed. The current predetermined resistance level that is selected includes the 25% resistance level.

Broadly, the resistance settings provided through the HMI 108 can be selected as the first resistance selection. As noted above, the first resistance selection is a macro or high-level resistance selection. The first resistance selection is chosen by a user through the HMI 108. Thus, the HMI 108 is not only configured to display the resistance settings for a particular user, but is also configured to receive a selection of one of the resistance settings.

The controller 110 generally includes a processor 128, a memory 130, and a communications interface 132. In some embodiments, the processor 128 executes instructions stored in memory 130 to provide various functional features, such as controlling operations of the HMI 108 and resistance assembly 106. These features include controlling specific structural components of the bicycle 100 and thus provide a practical application of the functions.

According to some embodiments, the controller 110 is configured to receive the first resistance selection from user input received through the HMI 108. In response, the controller 110 can transmit signals to the resistance assembly 106 to activate the resistance assembly 106 and selectively change a resistance force exerted by the resistance assembly 106 on the flywheel 104. To be sure, this resistance force is based on the first resistance selection received by the HMI 108. For example, using the resistance settings above, if the user selects the third resistance setting of 50%, the resistance assembly 106 increases the resistance force exerted on the flywheel 104 to 50% of a maximum resistance force.

In some embodiments, the maximum resistance force is the highest level of resistance that the resistance assembly 106 can exert on the flywheel 104. The maximum resistance force can be selected or based on the user's abilities in some embodiments.

Briefly referencing FIGS. 3 and 4A collectively, when the resistance assembly 106 comprises the electric motor 402 and magnetic holder bracket 404 arrangement (see FIG. 4A), the electric motor 402 is configured to selectively position the magnetic holder bracket 404 in relation to the flywheel 104 according to the resistance setting selected by the user as the first resistance selection. For example, the electric motor 402 can cause the magnetic holder bracket 404 to move closer to the flywheel 104 increasing a magnetic force exerted on the flywheel 104 by the magnetic holder bracket 404. The closer the magnetic holder bracket 404 is to the flywheel 104, the greater the resistance force.

In general, a maximum force level provided by the electric motor 402 and magnetic holder bracket 404 may depend on a position of the magnetic holder bracket 404 relative to the flywheel 104. In other words, the maximum resistance force is when the overlapping surface between magnets, such as magnets 403 and 405, and the flywheel 104 is maximum.

According to another embodiment (with reference to FIGS. 3 and 4B collectively), when the resistance assembly 106 comprises an electromagnetic brake 406 associated with the flywheel 104, the controller 110 can selectively alter a current applied to an electromagnet 408 of the electromagnetic brake 406 based on any of the first resistance selection. A corresponding increase in resistance force is generated by the electromagnet 408 as the current supplied to the electromagnet 408 from the current source 410 is increased. The current source 410 is operated through the controller 110 of the bicycle 100. The current source 410 could include any source of electrical energy such as a direct connection to an alternating current source. For example, the bicycle 100 could include an electrical cord that plugs into a standard 110 volt outlet. The current source 410 could include a battery or capacitor that stores electrical energy.

In general, a maximum force level that the electromagnet 408 can exert on the flywheel 104 is determined relative to a maximum current achievable in the windings of the electromagnet 408 according to the design of the electromagnet 408.

Referring to FIG. 3, in some embodiments the user-actuated resistance selector 112 referred to above generally includes a pair of levers 134 and 136. The lever 134 is coupled with a leftmost handle of the handlebars 126 while the lever 136 is coupled with a rightmost handle of the handlebars 126. While these are example placements of the user-actuated resistance selector 112 on the bicycle 100, other locations can also likewise be utilized. For example, in another embodiment, the levers could be associated with another part of the frame of the bicycle 100 such as a crossbar 127.

In general, the user-actuated resistance selector 112 is configured to receive a second resistance selection from the user. For example, the user can squeeze or toggle one or more of the levers 134/136 to provide the second resistance selection. In response, the controller 110 can activate the resistance assembly 106 to selectively refine the resistance force exerted on the flywheel 104 based on the second resistance selection received by the user-actuated resistance selector 112. Again, the second resistance selection causes a refinement of the resistance force that is already being applied to the flywheel 104 by the resistance assembly 106. Stated otherwise, the second resistance selection is utilized to make fine-tuned adjustments to the resistance force after the first resistance selection for the resistance force has been chosen.

Using the example above, the resistance assembly 106 is exerting a resistance force on the flywheel 104 that is approximately 50% of a maximum resistance force. The second resistance selection can include an increase or decrease of the resistance force in an incremental manner from the 50% value. For example, using the user-actuated resistance selector 112, the user can increase the resistance force to 54% of a maximum resistance force. This example is an arbitrary use case and is not intended to be limiting.

In one embodiment the lever 134 can be used to decrease the resistance force, while the other lever 136 is used to increase the resistance force. Similarly, lever 134 may be used to increase the resistance force, while the other lever 136 may be used to decrease the resistance force.

In some embodiments, the degree to which the resistance force is refined is based on how far the levers 134/136 are moved. For example, a travel of the lever 136 corresponds to a range of values that extend between the resistance setting of the first resistance selection and the next highest resistance setting above. In one embodiment, if the third resistance setting of 50% of the maximum resistance force was selected by the user, the next highest resistance setting would be 75% of the maximum resistance force. The travel of the lever 136 would allow for selective adjustment from 51% to 74%. The further the lever 136 travels the more resistance force is increased. When the lever 136 is moved fully the resistance force would be approximately 74% of the maximum resistance force.

Similarly, if the third resistance setting of 50% of the maximum resistance force was selected by the user, the next lowest resistance setting would be 25% of the maximum resistance force. The travel of the lever would allow for selective adjustment from 49% to 26%. The further the lever travels the more the resistance force is decreased. When the lever is moved fully the resistance force would be approximately 26% of the maximum resistance force.

In general, the user-actuated resistance selector 112 operates to change the resistance force on a more granular level than that which occurs based on the first resistance selection. For example, the user-actuated resistance selector 112 can be used to change the resistance level in 1% increments in one embodiment. However, any predefined increment can be utilized in other embodiments.

In some embodiments, the user-actuated resistance selector 112 can allow for adjustments to the resistance force of a magnitude that is greater or less than the example use case provided. Each of the levers 134 and 136 can be associated with a sensor or switch that senses the travel of the lever(s) and can generate a signal that is interpreted by the controller 110. That is, using the output of the sensor or switch associated with the lever(s), the controller 110 can fine tune the resistance force of the resistance assembly 106 accordingly.

In addition to providing macro and micro level changes in resistance force through the resistance assembly 106, the controller 110 can also be configured to selectively alter the resistance settings for the user based on a training level of the user. In one embodiment, the controller 110 receives a training level of the user through the HMI 108. For example, the user can enter their training level into the HMI 108. In some embodiments, the training level is provided by a trainer or other coach or administrator over the network 107 to the bicycle 100. This may allow the trainer to override the selections of the user in some embodiments.

In response to the input, the controller 110 can selectively adjust the plurality of predetermined resistance settings based on the training level of the user. In an example, if the training level is low-trained, the resistance settings could include a first resistance setting associated with a zero resistance level, a second resistance setting is associated with a 10 percent resistance level, a third resistance setting is associated with a 20 percent resistance level, a fourth resistance setting associated with a 30 percent resistance level, and a fifth resistance setting associated with a 40 percent resistance level. Alternatively, if the training level is highly-trained, a first resistance setting associated with a zero resistance level, a second resistance setting associated with a 25 percent resistance level, a third resistance setting is associated with a 50 percent resistance level, a fourth resistance setting is associated with a 75 percent resistance level, and a fifth resistance setting is associated with a 100 percent resistance level.

The percentages for each resistance level may be different for each training level. Thus, while the zero resistance level is a starting point for any training level, the highest resistance level is different based on whether the user selects the low-trained, moderately-trained or the highly-trained. In an example of a moderately-trained level a first resistance setting is associated with a zero resistance level, a second resistance setting is associated with an 18 percent resistance level, a third resistance setting is associated with a 36 percent resistance level, a fourth resistance setting is associated with a 54 percent resistance level, and a fifth resistance setting is associated with a 72 percent resistance level.

In other embodiments, rather than using a training level supplied by the user, the controller 110 can be configured to track a historical performance of the user over time. For example, the controller 110 tracks the user as they perform several workout routines on the bicycle 100 and/or treadmill 150. In various embodiments, the controller is configured to determine a current training level of the user based on the historical performance. That is, the controller 110 executes logic that determines a performance level for the user. Example methods for calculating and using performance levels can be found in co-pending U.S. application Ser. No. 16/289,243, filed on Feb. 28, 2019, titled "REAL-TIME AND DYNAMICALLY GENERATED GRAPHICAL USER INTERFACES FOR COMPETITIVE EVENTS AND BROADCAST DATA", which is hereby incorporated by reference herein in its entirety, including all references and appendices cited therein, for all purposes.

Based on the performance level or training level calculated using historical data, the controller 110 can selectively adjust the plurality of predetermined resistance settings. For example, the controller 110 can change the predetermined resistance settings from low-trained to moderately-trained based on a training level calculated using historical data.

In yet other embodiments, the controller 110 can receive predetermined resistance settings from the orchestration service 102 using the communications interface 132. The communications interface 132 can include any device or module that allows the controller 110 to connect to the network 107 to communicate with the orchestration service 102. According to some embodiments, the orchestration service 102 can provide live broadcasted workout media, such as video streams that are delivered to the bicycle 100 and/or treadmill 150.

In other embodiments, the orchestration service 102 can also provide the training level-based resistance setting analysis rather than the controller 110 of the bicycle 100, or a controller of a treadmill 150. Thus, the orchestration service 102 can comprise a real-time performance tracking and assessment module 140. The broadcast of data can be mediated through a broadcast or media module 142, in some embodiments.

Figure 6:
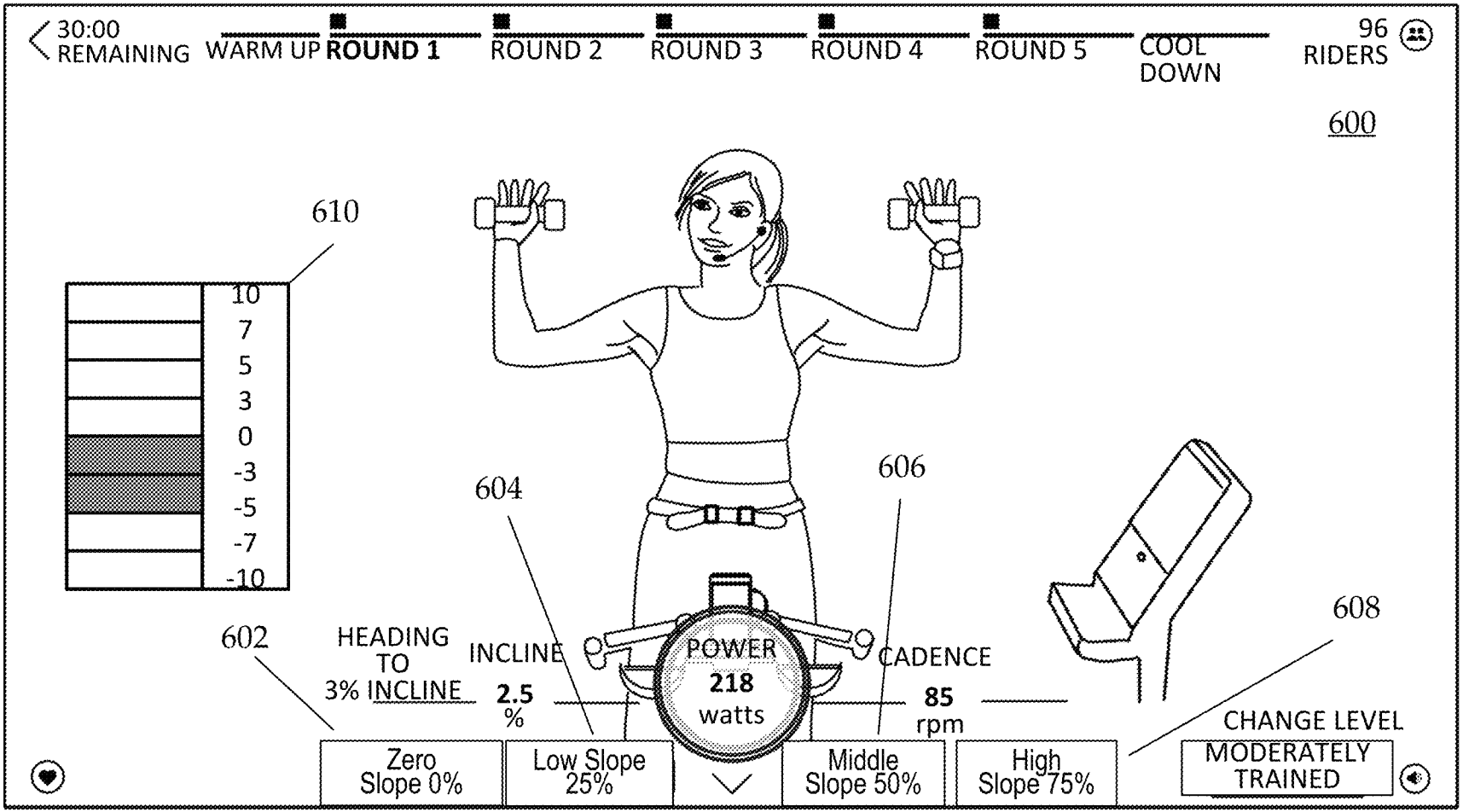
FIG. 6 is another graphical user interface in some embodiments of the present disclosure.

To be sure, while FIG. 3 illustrates and discloses manual levers as user-actuated resistance selectors, the user-actuated resistance selectors can be embodied as graphical user interface elements displayed on the HMI 108. For example, a user-actuated resistance selector includes a vertical slider that allows the user to make incremental selection changes in the resistance force. For example, FIG. 6 illustrates an example vertical slider that allows a user to increase or decrease the resistive force incrementally. Additional details regarding this embodiment are provided infra.

Figure 14:
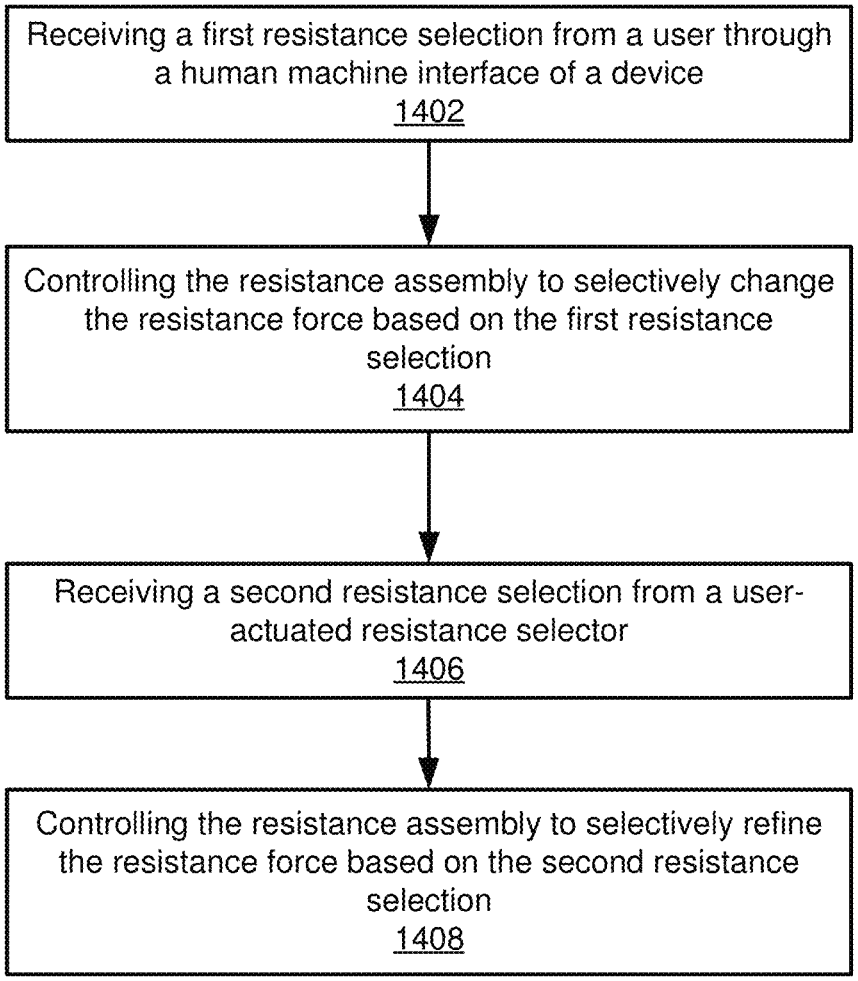
FIG. 14 is a flowchart of an example method of the present disclosure.

FIG. 14 is a flowchart of an example method of the present disclosure. The method includes a step 1402 of receiving a first resistance selection from a user through a human machine interface of a device. In some embodiments, the device includes a bicycle, or a treadmill. To be sure, the present disclosure could equally apply to any exercise equipment that contains a variable resistance mechanism such as a rowing machine, elliptical machine, step climbing machine or the like.

In various embodiments where the device is a bicycle, the device comprises at least one flywheel and a resistance assembly that exerts a resistance force that counteracts rotation of the at least one flywheel. In one embodiment, the resistance force associated with the first resistance selection is 35% of a maximum resistance level or force that can be exerted by the resistance assembly on the at least one flywheel.

In various embodiments where the device is a treadmill, the device comprises mechanisms to adjust a belt speed and/or belt incline of the treadmill to adjust the intensity of the workout and a level of effort required by the user.

Again, this step can occur when a user makes a selection on a touchscreen (HMI) of the device. In various embodiments, the user can select from a plurality of predetermined resistance settings. The HMI is configured to receive a first resistance selection among a plurality of predetermined resistance settings like for example: {0%, 10%, 20%, 30%, 40%} or {0%, 25%, 50%, 75%, 100%}. In a further example, the difference between two consecutive predetermined resistance settings is included in the range from 10% to 25%. In further embodiments of a bicycle or treadmill belt incline, the HMI is configured to receive a first resistance selection among a plurality of predetermined resistance settings like for example: {flat, hill, climb, top}, with each of those resistance levels having an associated numerical value. In exemplary embodiments of a treadmill belt speed, the HMI is configured to receive a first resistance selection among a plurality of predetermined resistance settings like for example: {walk, jog, run, spring} with each of those resistance levels having an associated numerical value.

The method also includes a step 1404 of controlling the resistance assembly to selectively change the resistance force based on the first resistance selection. This could include a controller issuing commands to the resistance assembly to change a current resistance force to the resistance force of 35% of a maximum resistance level for a bicycle, or a controller issuing commands to adjust a belt speed and/or belt incline of a treadmill.

Next, to fine tune the resistance force exerted by the resistance assembly on the at least one flywheel (where the device is a bicycle), the method includes a step 1406 of receiving a second resistance selection from a user-actuated resistance selector. In one example, this process includes a user toggling a lever or switch. The controller receives the second resistance selection and correspondingly causes the resistance assembly to adjust the resistance force applied to the at least one flywheel. For example, the user moves a lever (e.g., manual resistance selector) to change the resistance force from 35% to 37% of the maximum resistance level.

In an exemplary embodiment where the device is a treadmill, the secondary resistance selection from a user-actuated resistance selector serves to fine tune or adjust at least one of a treadmill belt speed and a treadmill belt incline level.

Thus, the method includes a step 1408 of controlling the resistance assembly (for a bicycle) or controlling a treadmill belt to selectively refine the resistance force based on the second resistance selection. In some embodiments, changes in resistance force are immediate allowing for real-time response and feedback.

As noted above, some methods can include aspects of performance tracking or dynamic altering of the predetermined resistance settings for a user. This allows the controller to adapt the user experience based on a training level for the user, which may vary over time.

Figure 5:
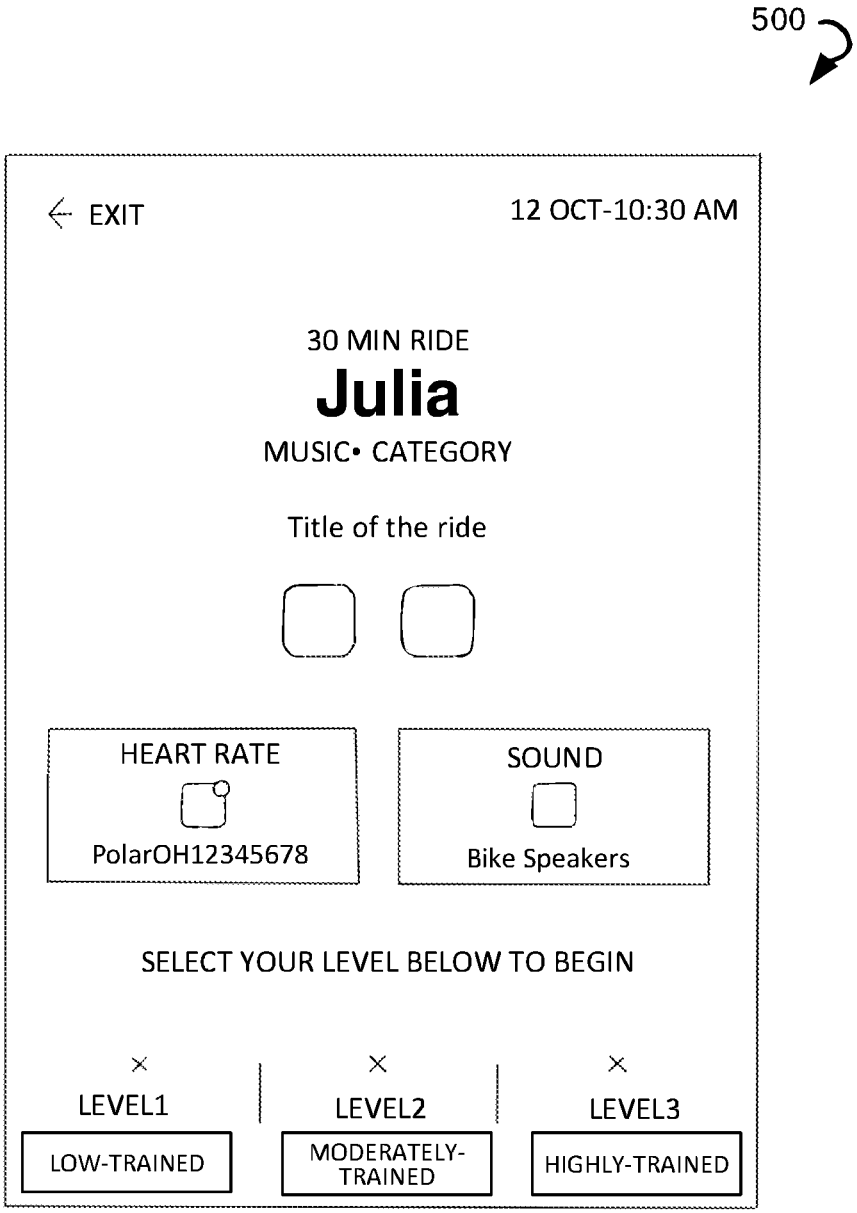
FIG. 5 is an example graphical user interface in some embodiments of the present disclosure.

FIG. 5 illustrates another example GUI 500 that provides a user with selections of training levels of low-trained, moderately-trained, and highly-trained. These values are relative to a workout referred to as Julia. At the beginning of the workout, the user selects by the HMI one of the three levels.

FIG. 6 illustrates a graphical user interface (GUI) 600 displayed during a workout. In more detail, the user can select on the GUI 600 one of four different resistance levels tabs that include zero slope 602, low slope 604, middle slope 606, and high slope 608. These labels are generally indicative of a resistance level or incline for the bicycle. To be sure, a pre-determined value of resistance is related to a specific resistance level. In other words, each of the resistance levels (e.g., zero slope, low slope, middle slope, and high slope) has a related pre-determined value of the braking resistance (e.g., resistance force) on the pedals. It will be understood that the selection is made using the GUI 600 and is another example macro-selection of a resistance setting.

In some embodiments, the user can change a macro-level resistance setting by selecting one of the four tabs 602-608, in this example. By pressing the tab 604 associated with a low slope, the resistance is set to the preset, macro-resistance value and the related tab can be highlighted to show to the user the current resistance level applied. This could include outlining the tab with a colored border or changing a color of the tab to differentiate it visually from the other tabs.

When the user refines the resistance by the levers (e.g., manual or virtual actuators), the resistance changes incrementally. In some embodiments, small changes effectuated by use of manual levers, the macro-resistance level remains the same (e.g., low slope) but for big changes by the levers, the user can modify the resistance level (e.g., to "zero slope" if the user has decreased the resistance or to "middle slope" if the user has increased the resistance of a certain amount). To be sure, the preset values of resistances are used as boundaries between the various resistance levels. These preset values correspond to the initial training level selected by the user, a trainer, or by a controller of the bicycle.

In one embodiment, the HMI provides four resistance tabs with the following associated resistance levels: 0% zero slope, 20% low slope, 30% middle slope, 40% high slope. If the user selects the tab "20% low slope", the macro-resistance setting of 20% is applied. Then, the user increases the resistance by one or more levers to be over or under the limit of the "low slope" resistance. For example, the user can increase the resistance setting to be 25%. The highlighted tab will be then middle slope, because the user has changed the resistance level to such a degree that the resistance level is now in the middle slope range.

In other words, the user can rapidly change the resistance level by the tabs and for each tab, a macro-resistance value is associated. When the user refines the resistance using any of the incremental input means disclosed herein (such as manual levers), micro-changes around the macro-resistance are applied. Adding more and more micro-changes, the user can move to the subsequent macro-resistance in some embodiments.

After the above mentioned macro-selection, the user can refine the resistance force using the levers of the handlebar. As noted above, one of the levers increases the resistance while the other one decreases the resistance force. By the handlebar levers, the user can improve the setting by selectively adjusting the resistance in smaller incremental intervals (e.g., micro-selection), around the current resistance level of the macro-selection. For example, the micro-selection incremental interval could be 0.5% or the like.

As noted above, each of the three settings has a corresponding set of resistance settings. For example, four resistance levels related to the LOW-TRAINED profile can be 0%, 20%, 30% and 40%, while the four resistance levels related to the MODERATELY-TRAINED profile can be 0%, 25%, 50% and 75%, and so on. The user can change their fitness level at any time during the workout by a specific button on the HMI.

It will be understood that in addition to the numerous advantages provided by the systems and methods disclosed above, the present disclosure advantageously contemplates and provides for rapid changes in resistance selections by macro or large amounts, for example by allowing transitions from the plurality of the macro-levels of resistance. Also, another advantage allows for refinement of the macro-level resistance through micro-level resistance setting selections using, for example, manual or virtual actuators. Advantageously, a user can adjust the first macro-level resistance selection to locate a desired and proper resistance, to maximize the effects of the workout.

As noted above, the GUI 600 includes an example vertical slider 610 that allows a user to increase or decrease the resistive force incrementally. The user can slide their finger up or down on the vertical slider 610 to selectively adjust the resistance force increments from three to seven percent. When the user swipes up the resistance force is increased and when the user swipes down the resistance force is decreased. In one example, when the low slope 20% is selected, the user can selectively adjust the resistance force downwardly five percent to 15%.

Figure 7:
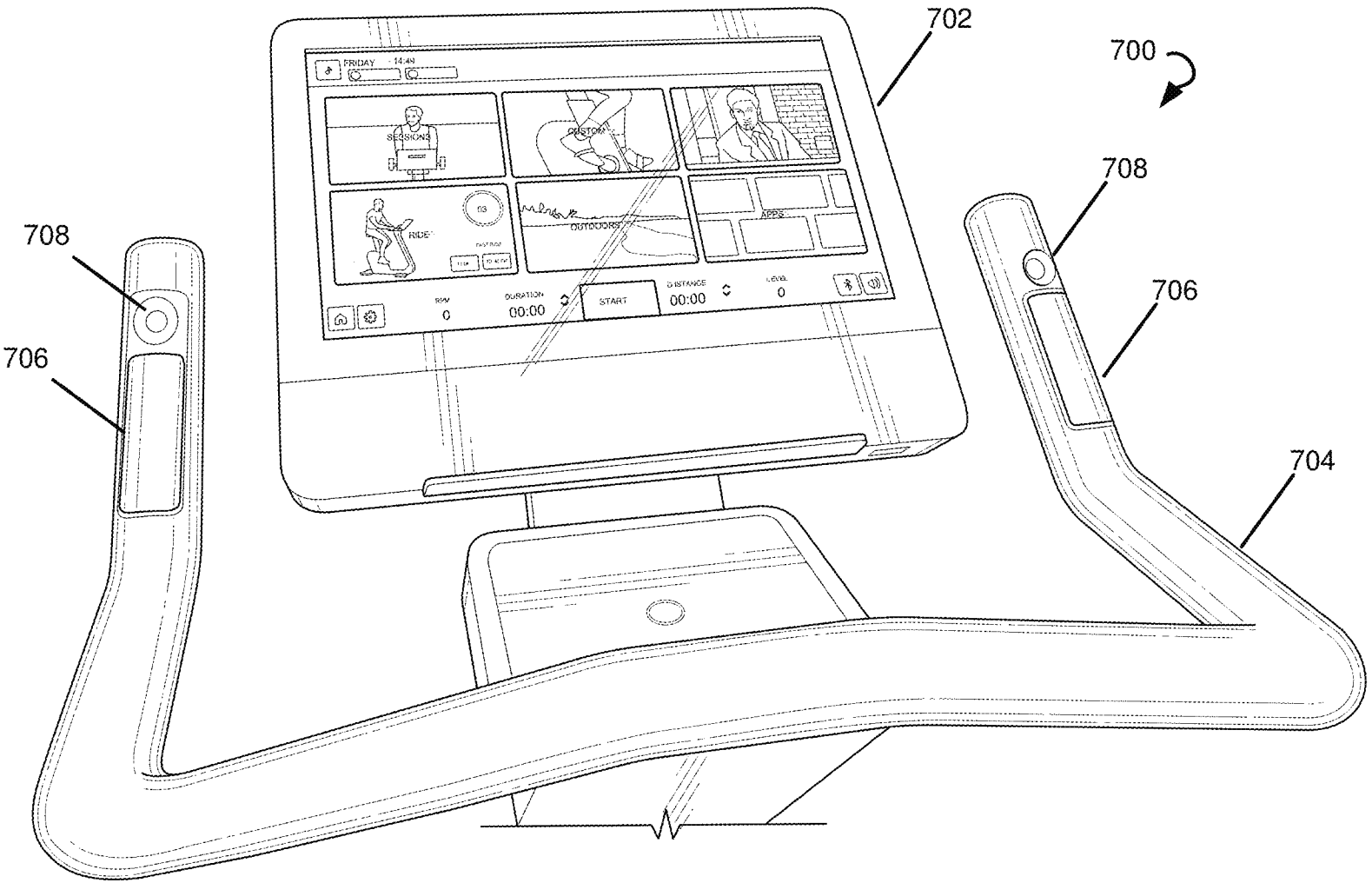
FIG. 7 is a schematic diagram of another device that is configured for use in accordance with embodiments of the present disclosure.

FIG. 7 illustrates another exemplary embodiment of an exercise machine 700 for embodiments of the present disclosure. In one example, exercise machine 700 is a bicycle, similar to bicycle 100 described herein. While not expressly depicted in FIG. 7, the bicycle comprises components such as a flywheel, resistance assembly, and controller. Further, exercise machine 700 comprises a human machine interface 702 (some or all of which may receive touch based input), a handlebar 704, hand rest 706, and user-actuated resistance selector 708. As described herein, the user-actuated resistance selectors may be used to provide a secondary resistance selection for the exercise machine, fine tuning a primary resistance selection made by the user through the human machine interface 702.

In an exemplary embodiment, a user begins a training session on exercise machine 700 by selecting a training level of beginner, intermediate, or advanced. While three training levels are described here, fewer or additional training levels may be used in other embodiments. Then the user makes a first resistance selection via human machine interface 702 of one of a predefined set of resistance levels. In exemplary embodiments, the predefined set of resistance levels may be presented on the HMI in varying colors.

After selection of a resistance level, exercise machine 700 automatically adjusts components of its resistance assembly via its controller to provide a comparable measure of resistance to the user pedaling, and displays the selected first resistance level on a graphical user interface of the HMI. Alternatively, if no selection of a first resistance level is received, the controller of exercise machine 700 may begin the workout with a default resistance level selection. In an exemplary embodiment the default resistance level is the lowest effort resistance level.

The user may then utilize one or more of the user-actuated resistance selector 708 to adjust resistance of exercise machine 700. One of the two user-actuated resistance selectors 708 on exercise machine 700 may allow the user to increase the resistance, while the other allows the user to decrease the resistance.

FIG. 8A depicts an exemplary chart of sample resistance levels that may be utilized for each training level. For example, if a user selects a "beginner" training level from the human machine interface 702, then the user has a choice of a first resistance selection of "top", "climb", "hill", or "flat". Each of these resistance levels has a corresponding value. For example, the beginner training level may have a "top" value of 8, a "climb" value of 6, a "hill" value of 5, and a "flat" value of 3.

Upon selection of one of these resistance levels from the HMI, the controller of the bicycle may automatically adjust its resistance assembly based on the corresponding numerical value. The user may then utilize a user-actuated resistance selector 708 to increase or decrease the value of the first resistance selection by a predetermined increment. For example, the predetermined increment may allow for adjustment by values such as 0.1, 0.2, 0.5, 1.0, or any other configurable value.

The predetermined increment may be the same or a different value for each of these four resistance levels. As would be understood by persons of ordinary skill in the art, while these four resistance levels are depicted in exemplary FIG. 8A for each training level, there may be fewer or additional resistance levels in other embodiments.

Further, each training level (beginner, intermediate, advanced) may have its own set of minimum and maximum values that are possible. For example, a beginner training level may allow a user to select a resistance level between 0 and 10, while an advanced training level may allow a user to select a resistance level between 0 and 14. In other embodiments, each of the training levels has the same range of minimum and maximum resistance values.

Figure 9:
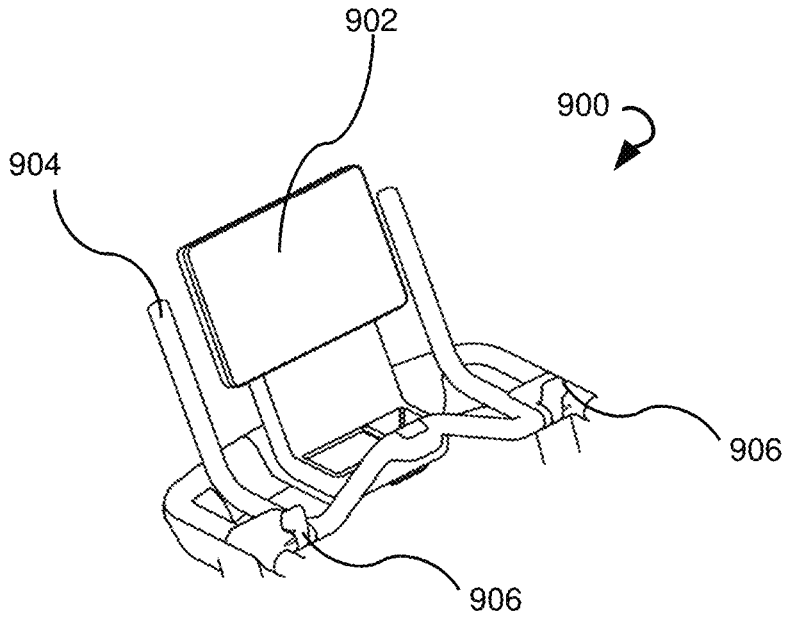
FIG. 9 is a partial view of another exemplary embodiment of an exercise machine in accordance with embodiments of the present disclosure.

FIG. 9 illustrates a partial view of another exemplary embodiment of an exercise machine 900 for embodiments of the present disclosure. In one example, exercise machine 900 is a treadmill, similar to treadmill 150 described herein with reference to FIG. 2.

While not expressly depicted in FIG. 9, the treadmill comprises components such as a frame which includes the rotating belt, pulleys, and a platform around which the belt rotates. A drive motor controls a speed of the belt, while a linear motor controls the gradient (aka incline) of the platform around which the belt rotates.

In some embodiments, a treadmill exercise machine may have two electronic controllers, similar to controller 110 discussed above. The first controller may be located near the HMI and collects the input from the user. The second controller may be located in the frame and controls the drive motor and linear motor based on the input received from the first controller. Thus, the controllers connect the user interface, sensors, actuators, and motors. In other embodiments, the treadmill exercise machine may have a singular controller operating these functions.

Further, exercise machine 900 comprises a human machine interface 902 (some or all of which may receive touch based input), handlebar 904, and user-actuated resistance selector 906. As described herein, the user-actuated resistance selectors may be used to provide a secondary resistance selection for the exercise machine, fine tuning a primary resistance selection made by the user through the human machine interface 902.

In an exemplary embodiment, a user begins a training session on exercise machine 900 by selecting a training level of beginner, intermediate, or advanced. While three training levels are described here, fewer or additional training levels may be used in other embodiments.

In some embodiments, the workout may automatically begin with a default belt speed and incline upon selection of a training level. In other embodiments, exercise machine 900 waits for a user to select a first speed level and/or first incline level via human machine interface 902 before starting.

In exemplary embodiments, the predefined set of speed levels and/or incline levels may be presented on the HMI in varying colors.

After selection of a first speed level and/or incline level, exercise machine 900 automatically adjusts the drive motor and/or linear motor to control the speed and/or incline of the belt, respectively.

The user may then utilize one or more of the user-actuated resistance selector 906 to adjust the belt speed and/or incline of exercise machine 900. In some embodiments, one of the two user-actuated resistance selectors 906 on exercise machine 900 may allow the user to increase or decrease a belt speed, while the other allows the user to increase or decrease a belt incline.

Figure 10:
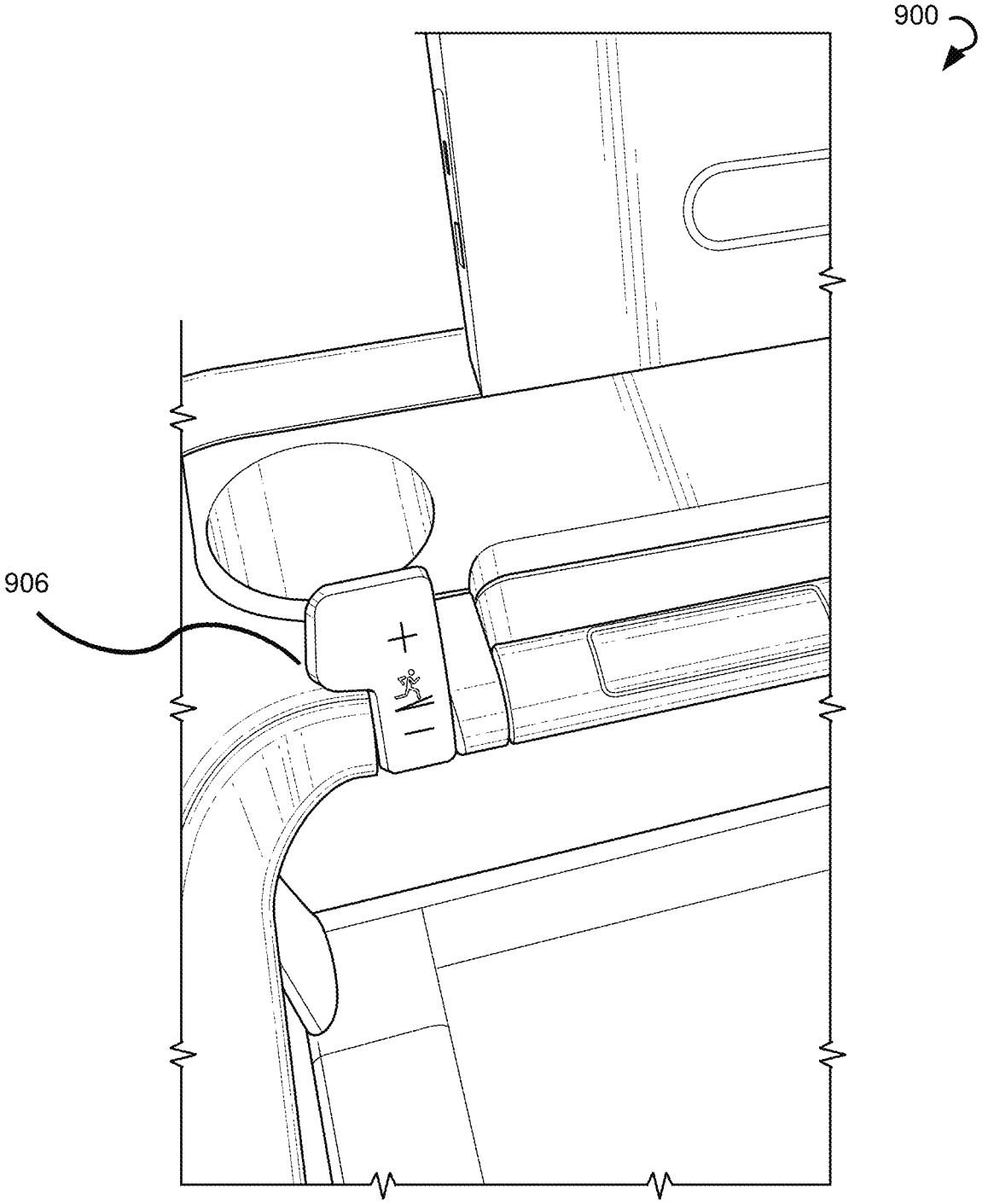
FIG. 10 is a closeup view of a user-actuated resistance selector of an exercise machine.

FIG. 10 depicts a closeup of a user-actuated resistance selector 906 of exercise machine 900. Depressing the "+" portion of the selector increases a value, while depressing the "–" portion of the selector decreases a value. The user-actuated resistance selector 906 may also be referred to as a manual lever herein.

FIGS. 8B and 8C depict exemplary charts of sample "resistance" levels that may be utilized for each training level of exercise machine 900. In an example embodiment, a treadmill has two configurable "resistances"—a speed of the treadmill belt and an incline of the treadmill belt.

FIG. 8B depicts exemplary resistance levels of "top", "climb", "hill", and "flat" for each of training levels Beginner, Intermediate, and Advanced for adjusting an incline of the treadmill belt. FIG. 8C depicts exemplary resistance levels of "sprint", "run", "jog", and "walk" for each of training levels Beginner, Intermediate, and Advanced, for adjusting a speed of the treadmill belt.

For example, if a user selects "beginner" from the human machine interface 902, then the user can select a first incline "resistance" level of "top" with a value of 7, a "climb" value of 5, a "hill" value of 2, and a "flat" value of 0. If selecting "top" from the HMI, a controller of the treadmill may automatically adjust its incline to a value of 7. Further, the user can select a first speed "resistance" level from the predefined speed levels of "sprint" with a value of 11.0, a "run" value of 8.0, a "jog" value of 6.5, and a "walk" value of 4.5.

Alternatively, if no selection of a first resistance level is received, the controller of exercise machine 900 may begin the workout with a default resistance level selection. In an exemplary embodiment the default resistance level is the lowest effort resistance level The user may then utilize a user-actuated resistance selector 906 to increase or decrease any of these settings by a predetermined increment. For example, the predetermined increment may allow for adjustment by values such as 0.1, 0.2, 0.5, 1.0, or any configurable value. The predetermined increment may be the same or a different value for each of these four resistance levels. As would be understood by persons of ordinary skill in the art, while these four resistance levels are depicted in exemplary FIGS. 8B and 8C for each training level, there may be fewer or additional resistance levels in other embodiments.

Further, each training level (beginner, intermediate, advanced) may have its own set of minimum and maximum values that are possible. For example, a beginner training level may allow a user to select a belt incline level between 0 and 10, while an advanced training level may allow a user to select a belt incline level between 0 and 14. In other embodiments, each of the training levels has the same range of minimum and maximum values.

In one example, a user selects a beginner training level and makes a first selection of speed level of "walk". In this case, the treadmill adjusts the drive motor to a "walk" speed of 4.5. The user can then utilize the user-actuated resistance selector 906 to decrease the speed to a value between 4.4 and 0. Alternatively, the user can utilize the user-actuated resistance selector 906 to increase the speed to a value between 4.6 and 6.4, since the "jog" setting starts at a speed of 6.5. In a further embodiment, the user can utilize the user-actuated resistance selector 906 to increase the speed to a value between 4.6 and the maximum possible belt speed for the machine.

Figure 11:
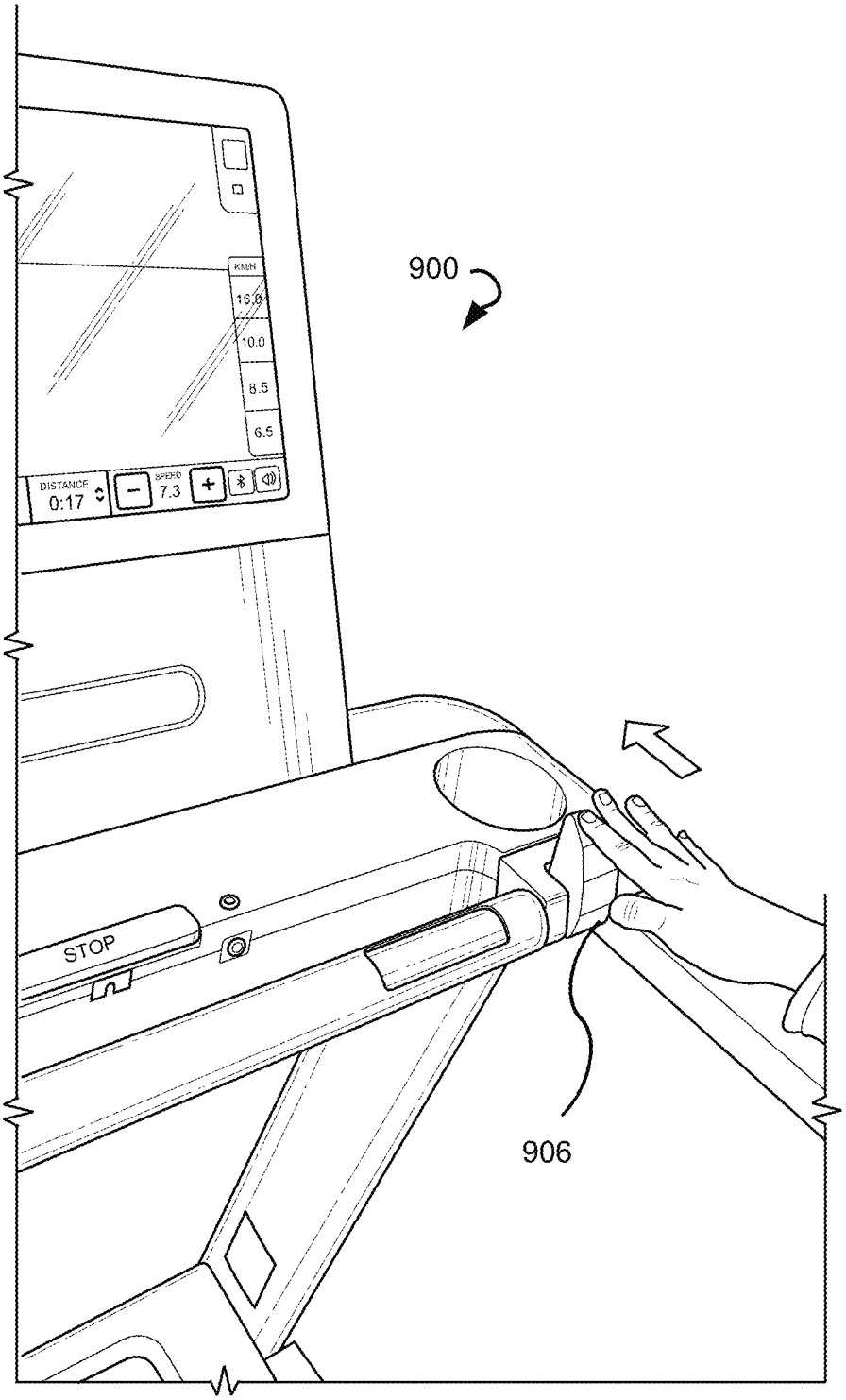
FIG. 11 is a partial view of an exercise machine, with a closeup of a user manually depressing user-actuated resistance selector to increase a value.
Figure 12:
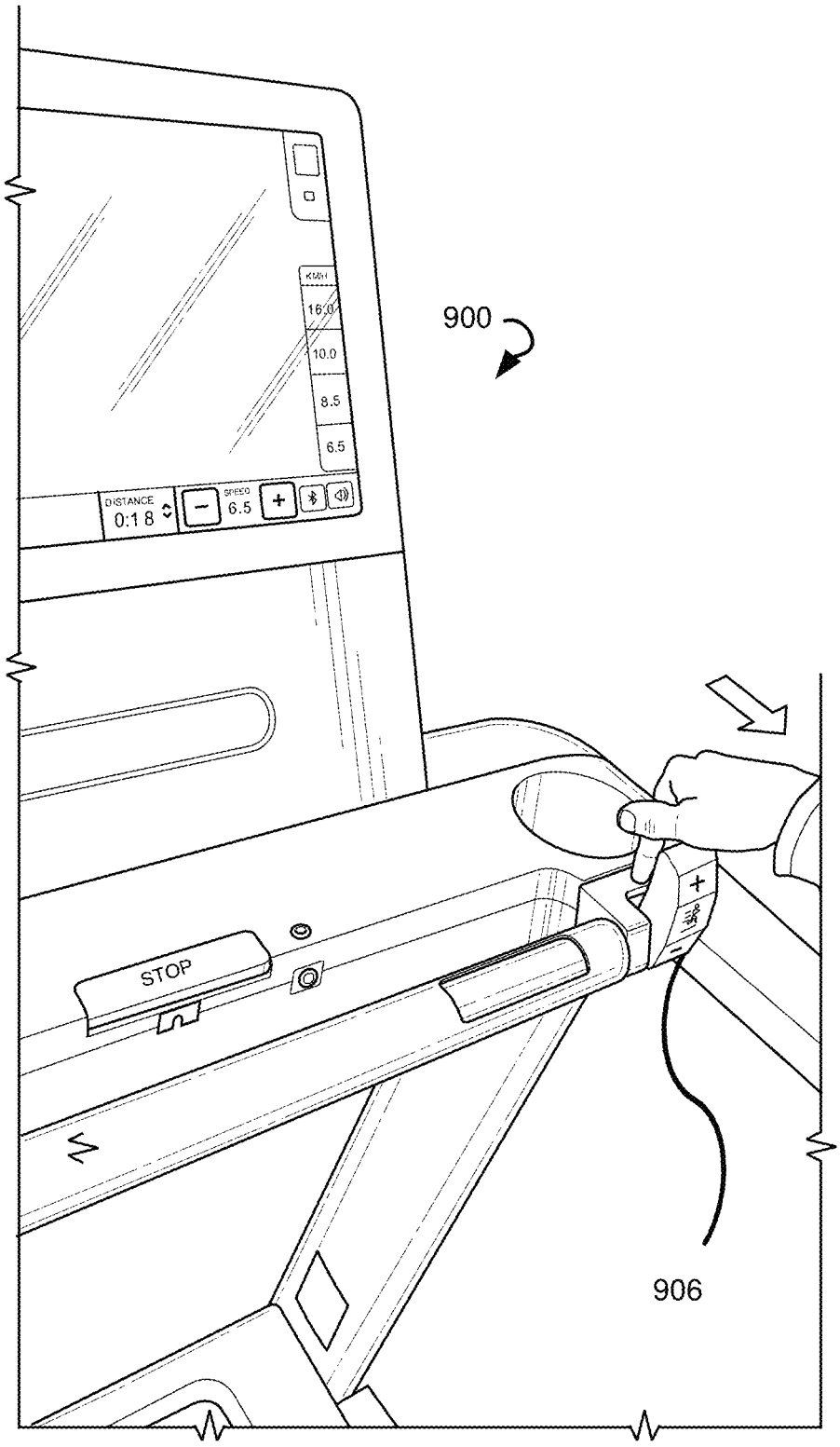
FIG. 12 is a partial view of an exercise machine, with a closeup of a user manually depressing user-actuated resistance selector to decrease a value.

FIG. 11 depicts a partial view of exercise machine 900 of FIG. 9, with a closeup of a user manually depressing user-actuated resistance selector 906 to increase a "resistance" value. FIG. 12 depicts a partial view of exercise machine 900 of FIG. 9, with a closeup of a user manually depressing user-actuated resistance selector 906 to decrease a "resistance" value. As discussed herein, for a treadmill, the user can increase or decrease one or both of a treadmill belt speed and belt incline level.

Figure 13:
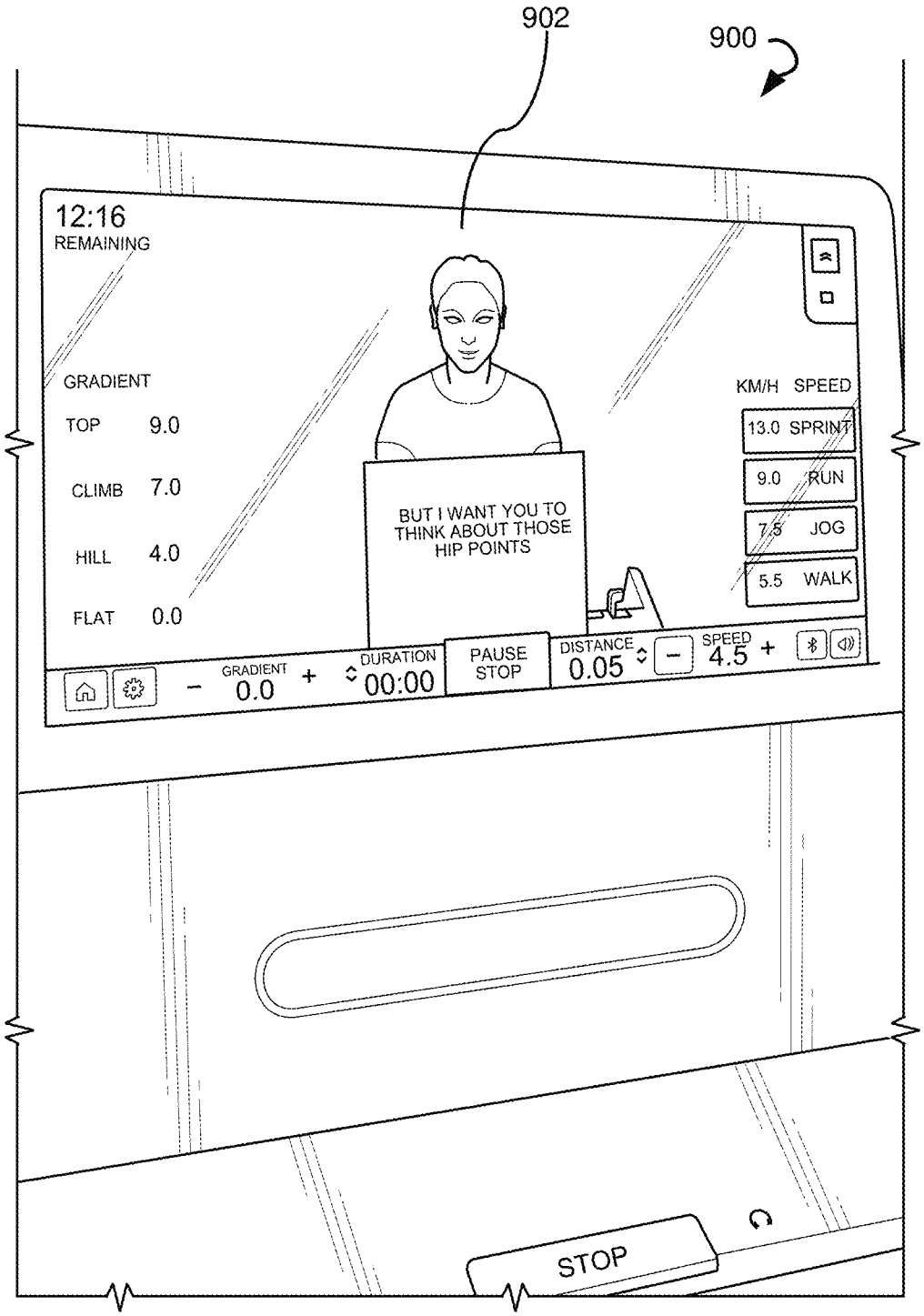
FIG. 13 is a partial view of an exercise machine, with a closeup of an interface of the HMI.

FIG. 13 depicts a partial view of exercise machine 900 of FIG. 9, with a closeup of an interface of the HMI 902. In the interface, exemplary treadmill belt speeds are depicted on the bottom right, and exemplary treadmill gradients (also referred to herein as inclines) are depicted on the bottom left. The currently selected speed value of 4.5 is shown in the bottom horizontal bar, along with the currently selected gradient value of 0.0. Plus and minus buttons are also shown to allow the user to adjust the speed or gradient through HMI 902 instead of, or in addition to, adjustment by a manual user-actuated resistance selector.

Figure 15:
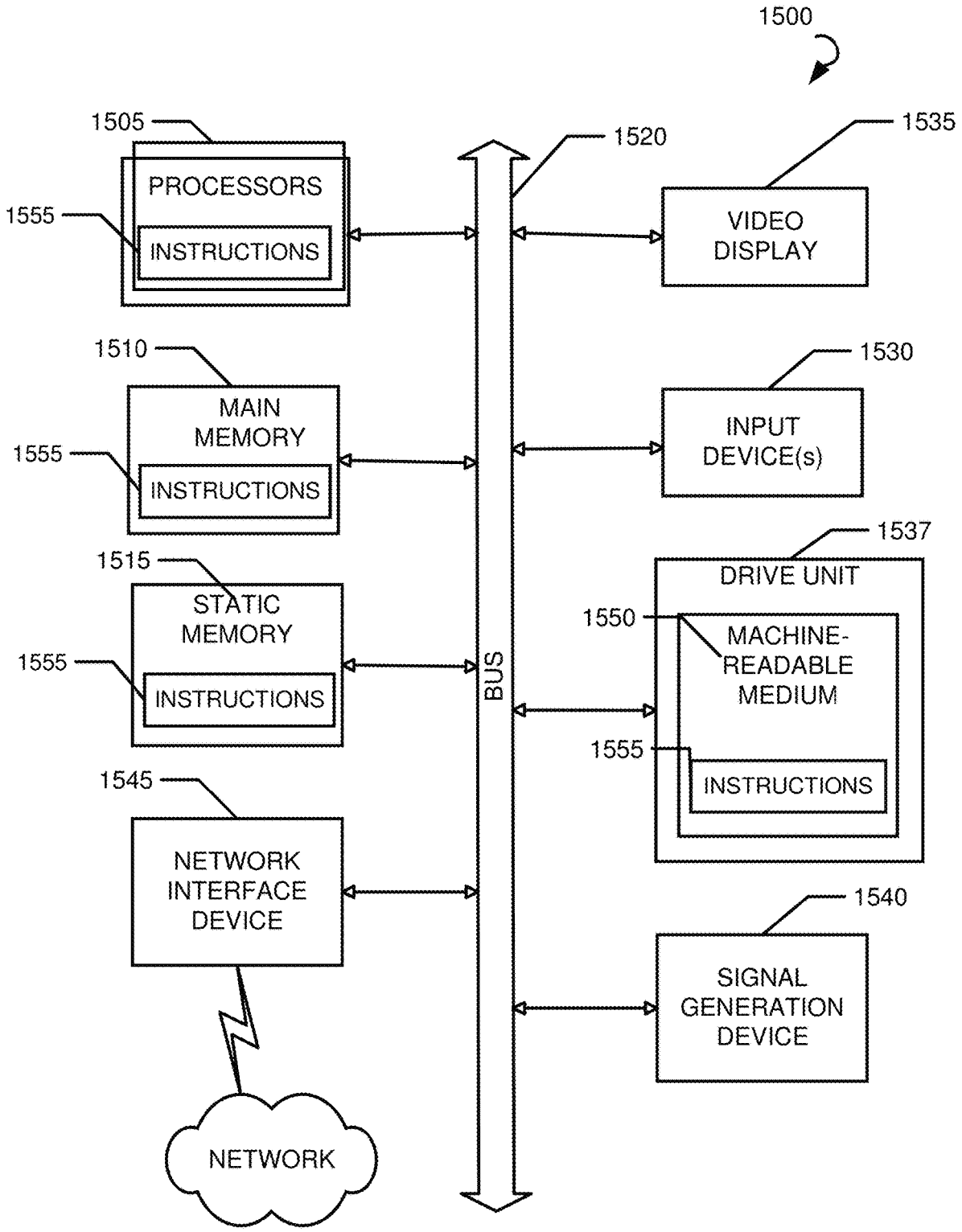
FIG. 15 is a diagrammatic representation of an example machine in the form of a computer system.

FIG. 15 is a diagrammatic representation of an example machine in the form of a computer system 1500, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a portable music player (e.g., a portable hard drive audio device such as a Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1500 includes a processor or multiple processor(s) 1505 (e.g., a central processing unit (CPU), a graphics processing unit (GPU), or both), and a main memory 1510 and static memory 1515, which communicate with each other via a bus 1520. The computer system 1500 may further include a video display 1535 (e.g., a liquid crystal display (LCD)). The computer system 1500 may also include an alpha-numeric input device(s) 1530 (e.g., a keyboard), a cursor control device (e.g., a mouse), a voice recognition or biometric verification unit (not shown), a disk drive unit 1537 (also referred to as disk drive unit), a signal generation device 1540 (e.g., a speaker), and a network interface device 1545. The computer system 1500 may further include a data encryption module (not shown) to encrypt data.

The disk drive unit 1537 includes a computer or machine-readable medium 1550 on which is stored one or more sets of instructions and data structures (e.g., instructions 1555) embodying or utilizing any one or more of the methodologies or functions described herein. The instructions 1555 may also reside, completely or at least partially, within the main memory 1510 and/or within the processor(s) 1505 during execution thereof by the computer system 1500. The main memory 1510 and the processor(s) 1505 may also constitute machine-readable media.

The instructions 1555 may further be transmitted or received over a network via the network interface device 1545 utilizing any one of a number of well-known transfer protocols (e.g., Hyper Text Transfer Protocol (HTTP)). While the machine-readable medium 1550 is shown in an example embodiment to be a single medium, the term "computer-readable medium" should be taken to include a single-medium or multiple-media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

One skilled in the art will recognize that the Internet service may be configured to provide Internet access to one or more computing devices that are coupled to the Internet service, and that the computing devices may include one or more processors, buses, memory devices, display devices, input/output devices, and the like. Furthermore, those skilled in the art may appreciate that the Internet service may be coupled to one or more databases, repositories, servers, and the like, which may be utilized to implement any of the embodiments of the disclosure as described herein.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the present technology in the form disclosed. Many modifications and variations will be apparent to those of ordinary skill in the art without departing from the scope and spirit of the present technology. Exemplary embodiments were chosen and described to best explain the principles of the present technology and its practical application, and to enable others of ordinary skill in the art to understand the present technology for various embodiments with various modifications as are suited to the particular use contemplated.

Aspects of the present technology are described above with reference to flowchart illustrations and/or block diagrams of methods, apparatus (systems) and computer program products according to embodiments of the present technology. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

In the following description, for purposes of explanation and not limitation, specific details are set forth, such as particular embodiments, procedures, techniques, etc. to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled," "connected", "connecting," "electrically connected," etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity regardless of the type (analog or digital) of those signals. It is further noted that various figures (including component diagrams) shown and discussed herein are for illustrative purposes only, and are not drawn to scale.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

The terminology used herein can imply direct or indirect, full or partial, temporary or permanent, immediate or delayed, synchronous or asynchronous, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

While various embodiments have been described above, they have been presented by way of example only, and not limitation. The descriptions are not intended to limit the scope of the invention to the forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A treadmill, comprising:

a platform around which a belt rotates;

a drive motor configured to control a speed of rotation of the belt;

a linear motor configured to control an incline of the platform;

a human machine interface configured to receive a first selection from a user, the first selection being at least one of the speed of rotation of the belt and the incline of the platform;

at least one manual lever configured to receive a second selection from the user, the second selection refining the first selection, wherein the at least one manual lever is a standalone manual control disconnected and separate from another manual control; and at least one controller comprising a processor and a memory, the processor executing instruction stored in the memory to:

activate the drive motor to selectively change the speed of rotation of the belt based on the first selection received by the human machine interface, or activate the linear motor to selectively change the incline of the platform based on the first selection received by the human machine interface; and activate at least one of the drive motor and the linear motor to selectively refine the first selection based on the second selection received by the at least one manual lever.

2. The treadmill according to claim 1, wherein the first selection comprises one of a plurality of predetermined platform incline levels, with each platform incline level associated with a unique selection for the linear motor.

3. The treadmill according to claim 1, wherein the first selection comprises one of a plurality of predetermined belt speed levels, with each being associated with a unique selection for the drive motor.

4. The treadmill according to claim 1, wherein the at least one controller is configured to:

track a historical performance of the user over time;

determine a current training level of the user based on the historical performance; and selectively adjust at least one of a plurality of predetermined belt speed levels and a plurality of predetermined platform incline levels, based on the current training level of the user.

5. The treadmill according to claim 1, wherein the at least one controller is further configured to:

receive a training level of the user through the human machine interface; and selectively adjust a plurality of predetermined belt speed settings and a plurality of predetermined platform incline settings based on the training level that is received.

6. The treadmill according to claim 1, wherein the at least one manual lever is on a handlebar of the treadmill.

7. The treadmill according to claim 1, wherein the first selection is the speed of rotation of the belt.

8. The treadmill according to claim 1, wherein the first selection is the incline of the platform.

9. The treadmill according to claim 1, wherein the at least one manual lever is configured to be depressed in one direction to increase the first selection and depressed in an opposite direction to decrease the first selection.

10. The treadmill according to claim 1, further comprising a communications interface, the communications interface being configured to receive a plurality of predetermined belt speed settings and a plurality of predetermined platform incline settings, which are displayable on the human machine interface and selectable by the user as the first selection.

11. A method, comprising:

receiving a first selection from a user through a human machine interface of a treadmill, the treadmill comprising a platform around which a belt rotates, a drive motor configured to control a speed of rotation of the belt, and a linear motor configured to control an incline of the platform, the first selection being at least one of the speed of rotation of the belt and the incline of the platform;

controlling at least one of the drive motor and the linear motor to selectively change at least one of the speed of rotation of the belt and the incline of the platform based on the first selection;

receiving a second selection from at least one manual lever, the second selection refining the first selection, wherein the at least one manual lever is a standalone manual control disconnected and separate from another manual control; and controlling at least one of the drive motor and the linear motor to selectively and respectively refine at least one of the speed of rotation of the belt and the incline of the platform based on the second selection.

12. The method according to claim 11, further comprising establishing a plurality of predetermined platform incline levels, with each platform incline level associated with a unique selection for the linear motor, and based on a maximum incline.

13. The method according to claim 11, further comprising establishing a plurality of predetermined belt speed levels, with each belt speed level associated with a unique selection for the drive motor, and based on a maximum belt speed.

14. The method according to claim 11, further comprising:

tracking a historical performance of the user over time;

determining a current training level of the user based on the historical performance; and selectively adjusting at least one of a plurality of predetermined belt speed levels and a plurality of predetermined platform incline levels, based on the current training level of the user.

15. The method according to claim 11, further comprising:

receiving a training level of the user through the human machine interface; and selectively adjusting a plurality of predetermined belt speed settings and a plurality of predetermined platform incline settings based on the training level.

16. The method according to claim 11, wherein the at least one manual lever is on a handlebar of the treadmill.

17. The method according to claim 11, wherein the first selection is the speed of rotation of the belt.

18. The method according to claim 11, wherein the first selection is the incline of the platform.

19. The method according to claim 11, wherein the at least one manual lever is configured to be depressed in one direction to increase the first selection and depressed in an opposite direction to decrease the first selection.

20. A treadmill, comprising:

a platform around which a belt rotates;

a drive motor configured to control a speed of rotation of the belt;

a linear motor configured to control an incline of the platform;

a human machine interface configured to receive a first selection from a user, the first selection being at least one of the speed of rotation of the belt and the incline of the platform;

at least one manual lever configured to receive a second selection from the user, the second selection refining the first selection, wherein the at least one manual lever is a standalone manual control disconnected and separate from another manual control;

a first controller comprising a first processor and a first memory, the first processor configured to execute instructions stored in the first memory to receive the first selection by the user from the human machine interface; and a second controller in communication with the first controller, the second controller comprising a second processor and a second memory, the second processor configured to execute instructions stored in the second memory to:

activate the drive motor to selectively change the speed of rotation of the belt based on the first selection received by the first controller, or activate the linear motor to selectively change the incline of the platform based on the first selection received by the first controller; and activate at least one of the drive motor and the linear motor to selectively refine the first selection based on the second selection received by the at least one manual lever.

* * * * *